US008499601B2

(12) United States Patent
Hanafusa et al.

(10) Patent No.: US 8,499,601 B2
(45) Date of Patent: Aug. 6, 2013

(54) BOTTLE CAN MEMBER, BOTTLE, AND THREAD FORMING DEVICE

(75) Inventors: Tatsuya Hanafusa, Gotenba (JP); Ryoichi Ito, Gotenba (JP); Masahiro Hosoi, Gotenba (JP); Naoki Tasaka, Susono (JP)

(73) Assignee: Universal Can Corporation, Tokyo (JP)

( * ) Notice: Subject to any disclaimer, the term of this patent is extended or adjusted under 35 U.S.C. 154(b) by 0 days.

(21) Appl. No.: 13/475,242

(22) Filed: May 18, 2012

(65) Prior Publication Data

US 2012/0269602 A1 Oct. 25, 2012

Related U.S. Application Data

(62) Division of application No. 12/874,465, filed on Sep. 2, 2010, which is a division of application No. 10/500,344, filed as application No. PCT/JP02/13840 on Dec. 27, 2002, now Pat. No. 7,798,357.

(30) Foreign Application Priority Data

| | | |
|---|---|---|
| Dec. 28, 2001 | (JP) | 2001-401686 |
| Jul. 2, 2002 | (JP) | 2002-193465 |
| Jul. 5, 2002 | (JP) | 2002-197799 |
| Aug. 9, 2002 | (JP) | 2002-233917 |

(51) Int. Cl.
*B21H 3/04* (2006.01)

(52) U.S. Cl.
USPC ..... 72/104; 72/105; 72/379.4; 413/23

(58) Field of Classification Search
USPC ..... 72/102–106, 379.4, 715; 413/8, 413/23, 69, 76
See application file for complete search history.

(56) References Cited

U.S. PATENT DOCUMENTS

| | | | |
|---|---|---|---|
| 650,429 | A | 5/1900 | Smith |
| 1,569,875 | A | 1/1926 | Nixon |

(Continued)

FOREIGN PATENT DOCUMENTS

| | | | |
|---|---|---|---|
| EP | 1468925 | A1 | 10/2004 |
| JP | 5-229545 | | 9/1993 |

(Continued)

OTHER PUBLICATIONS

Korean Office Action issued on Dec. 6, 2010 for the corresponding Korean Application No. 10-2010-7020072.

(Continued)

*Primary Examiner* — David B Jones
(74) *Attorney, Agent, or Firm* — Leason Ellis LLP.

(57) ABSTRACT

An effective thread number in the thread section which is disposed on the mouth section of the bottle is formed to be 2.2. That is, the thread section is formed such that the thread section 13 should serve effectively in the mouth section such that an interval between a start position and an end position should be 2.0 to 2.5. In the bottle can member 11 which has such a thread section, an outer diameter of the thread section which is formed on the mouth section is 28 to 38 mm. Also, the thickness of the mouth section is 0.25 to 0.4 mm. The thread section which has the effective thread number 2.0 to 2.5 is formed by eight-thread per inch pitch. By doing this, it is possible to put the cap desirably.

3 Claims, 20 Drawing Sheets

U.S. PATENT DOCUMENTS

| | | | | | |
|---|---|---|---|---|---|
| 2,145,587 | A | * | 1/1939 | Draper | 72/115 |
| 2,644,608 | A | | 7/1953 | Lee | |
| 2,664,136 | A | * | 12/1953 | Hornberger et al. | 72/103 |
| 2,666,348 | A | | 1/1954 | Trishman | |
| 2,994,946 | A | | 8/1961 | Reynolds | |
| 3,395,562 | A | | 8/1968 | Bushi | |
| 4,102,168 | A | | 7/1978 | Brookes et al. | |
| 4,221,105 | A | | 9/1980 | Guest | |
| 4,798,303 | A | | 1/1989 | Arnold | |
| 5,293,765 | A | * | 3/1994 | Nussbaum-Pogacnik | 72/103 |
| 5,704,240 | A | * | 1/1998 | Jordan | 72/103 |
| 5,718,352 | A | | 2/1998 | Diekhoff et al. | |
| 5,785,195 | A | | 7/1998 | Zwemer et al. | |
| 6,010,028 | A | | 1/2000 | Jordan et al. | |
| 6,286,357 | B1 | | 9/2001 | D'Amore et al. | |
| 7,798,357 | B2 | | 9/2010 | Hanafusa et al. | |
| 7,963,139 | B2 | * | 6/2011 | Shortridge et al. | 72/117 |

FOREIGN PATENT DOCUMENTS

| | | | |
|---|---|---|---|
| JP | 7-38166 | Y2 | 8/1995 |
| JP | 2000-191006 | A | 7/2000 |
| JP | 2001-010627 | A | 1/2001 |
| JP | 2001-063715 | A | 3/2001 |
| JP | 2001-162344 | | 6/2001 |
| JP | 2001-213416 | A | 8/2001 |
| JP | 2001-213417 | A | 8/2001 |
| JP | 2001-233332 | A | 8/2001 |
| JP | 2001-233333 | A | 8/2001 |
| JP | 2001-294251 | A | 10/2001 |
| JP | 2001-315745 | A | 11/2001 |
| JP | 2002-019756 | A | 1/2002 |
| JP | 2002-219539 | A | 8/2002 |
| JP | 2004-130386 | A | 4/2004 |

OTHER PUBLICATIONS

U.S. Office Action mailed Jan. 28, 2011 for the related U.S. Appl. No. 12/874,520.

U.S. Office Action mailed Apr. 6, 2011 for the related U.S. Appl. No. 12/874,557.

U.S. Notice of Allowance mailed Nov. 8, 2011 for the related U.S. Appl. No. 12/874,557.

Korean Office Action mailed Jun. 4, 2010 for the corresponding Korean Patent Application No. 10-2004-7010080.

Information Submission Form from JPO for JP2002-193465 mailed Sep. 13, 2005.

Information Submission Form from JPO for JP2002-381111 mailed Sep. 13, 2005.

Notice of Reasons for Rejection from JPO for JP2002-193465 mailed Sep. 13, 2005.

Information Submission Form from JPO for JP2002-193465 mailed Oct. 4, 2005.

Information Submission Form from JPO for JP2002-233917 mailed Oct. 4, 2005.

Official Notification from the Japanese Patent Office for JP2002-193465, mailed Feb. 22, 2005.

Official Notification from the Japanese Patent Office for JP2002-381111, mailed Feb. 22, 2005.

"Development of "DAKARA" Aluminum Bottle Can", JPI Journal, Japan Packaging Institute, vol. 38, No. 9, pp. 9-15.

Patent Abstracts of Japan for JP2001-213417 published Aug. 7, 2001.

Patent Abstracts of Japan for JP2001-063715 published Mar. 13, 2001.

Patent Abstracts of Japan for JP2001-010627 published Jan. 16, 2001.

* cited by examiner

BOTTLE CAN MEMBER, BOTTLE, AND THREAD FORMING DEVICE

CROSS REFERENCES TO PRIOR APPLICATIONS

This application is a Divisional of U.S. patent application Ser. No. 12/874,465, filed Sep. 2, 2010, which is a Divisional of U.S. patent application Ser. No. 10/500,344, filed Jun. 24, 2004, now issued U.S. Pat. No. 7,798,357, which is a U.S. national phase application under 35 U.S.C. §371 of International Patent Application No. PCT/JP02/13840 filed Dec. 27, 2002, and claims the benefit of Japanese Patent Application Nos. 2001-401686 filed Dec. 28, 2001; 2002-193465 filed Jul. 2, 2002; 2002-197799 filed Jul. 5, 2002 and 2002-233917 filed Aug. 9, 2002 which are incorporated by reference herein. The International Application was published in Japanese on Jul. 17, 2003 as WO 03/057572 A1 under PCT Article 21(2).

FIELD OF THE INVENTION

The present invention relates to a metal bottle can, a thread forming device in which a thread section is formed on a mouth section. Furthermore, the present invention relates to a method for forming a mouth section.

BACKGROUND OF THE INVENTION

A so-called bottle can member 1 which is formed by a drawing operation for a metal bottle member has a thread section 3 on a mouth section 2 and an outer periphery on an aperture section of the bottle can member 1 which is formed in a cylindrical shape which has a bottom section as shown in FIG. 6A. A product such as a drink water are filled in the bottle can member from the thread section 3. After that, an outer periphery of a cap 5 is compressed in accordance with the thread section 3. By doing this, the cap 5 is put thereon as shown in FIG. 6B. The cap 5 comprises a cap main upper section 6 to which a cap thread section 7 is formed in accordance with the thread section 3 of the bottle can member 1 and a cap main bottom section 9 which is formed on a bottom end of the cap main upper section 6 so as to expand over the bottom section of an expanding section 4.

Also, before the cap 5 is put has a shape like a cap member 5' as shown in FIG. 6C such that an upper section is ceiled by a ceiling plate and its bottom section has an aperture section orthogonally in a downward direction so as to be a cylindrical shape. A score 8*a* which is formed in a plurality of cutting sections which are formed in a circumferential direction and a bridge 8*b* are disposed alternatively in a bridge section 8 such that the cap main body bottom section 9 is connected via the bridge section 8.

In order to remove the cap 5 from the bottle can member 1, a relative rotative force is applied to the cap 5 and the bottle can member 1. Such a rotative force serves such that the cap 5 should be moved upwardly by the thread section 3. However, the cap main body bottoms section 9 is engaged to an expanding section 4 of the bottle can member 1; therefore, the bridge 8*b* is broken; thus, the cap main body upper section 6 and the cap main body bottom section 9 are separated. Consequently, the cap main body bottom section 9 remains in the mouth section 2; thus, the cap main body upper section 6 is removed from the bottle can member 1. That is, the cap is opened on the bottle can member 1 by rotating the cap 5 by a user such that the bridge section 8 should be broken.

Conventionally, in the bottle can member 1 which has such a thread section 3, a diameter of an aperture section of a bottomed cylindrical bottle can member 1 as shown in FIG. 7A is reduced temporarily as shown in FIG. 7B. After that, as shown in FIG. 7C, a predetermined distance from the aperture end of the mouth section 2 is enlarged so as to form an enlarged diameter section 2'. Furthermore, as shown in FIG. 7D, a thread section 3 is formed in a constant distance from the aperture end such that an enlarged diameter section in which the thread section 3 is not formed remains for an expanding section 4; thus, the expanding section 4 is formed.

For an outer diameter A of the cap 5 which is put on the bottle can member 1 as shown in FIGS. 6A to 6C, there are three standards such as 28 mm, 33 mm, and 38 mm. An outer diameter B of the mouth section 1 of the bottle can member 1 is formed so as to be smaller than the outer diameter A of the cap 5. If the cap 5 which has 38 mm outer diameter is put to the thread section 3, the thread section 3 is formed so as to have an effective thread turn number approximately 1.5 to 1.7. The effective thread turn number is defined as a number of turns that are formed at a portion where the thread functions effectively.

Here, the effective thread turn number represents the number of thread turns that are formed at an effective thread section which is shown as X in FIG. 8. FIG. 8 is a view for explaining an over view for the thread section 3 in which Y and Z are incomplete thread sections. W indicates a perfect thread section. C indicates a center point. The thread section 3 is formed by a mountain section 3*a* and a valley section 3*b*. The incomplete thread section Y is formed in a starting side of an upper end of the mouth section 2. The incomplete thread section Z is formed an ending side of a base end side of the mouth section 2. Outer diameters for the mountain section 3*a* and the valley section 3*b* for a perfect thread section W between the incomplete thread section Y and the incomplete thread section Z are formed in predetermined diameters respectively. The diameter of the peak of the thread of the incomplete thread section Y increases gradually from an end point Y1 toward a starting point W1 of the perfect thread section W. The diameter of the valley of the thread of the incomplete thread section Z increases gradually from an end point W2 of the perfect thread section W toward the end point Z2.

The effective thread section X corresponds to a section starting at an effective thread start point X1, which is in a middle of the incomplete thread section Y, containing the entire portion of the perfect thread section W, and ending at an effective thread end point X2, which is in a middle of the incomplete thread section Z. The effective thread start point X1 is a cross point which is made by a bisector L1 which divides an acute angle $\angle\alpha$ for an incomplete thread section Y which is formed by an end point Y1, a center point C, and a starting point W1 and an incomplete thread section Y. An effective thread end point X2 is a cross point which is formed by a bisector L2 for an acute angle $\angle\beta$ for the incomplete thread section Z which is formed by an end point W2, a center point C, and an end point Z2.

However, in a conventional bottle can member 1, if the effective thread turn number in the thread section 3 which is disposed in the mouth section 2 of the bottle can member 1 is approximately 1.5 to 1.7, a section in which there are two threads which are disposed toward a tip section from a base end section of the mouth section 2 and a section in which there is only one thread occur; thus, such a difference of the threads causes a problem. That is, if the thread turn number is formed as explained above, if a cap 5 is put on the bottle can member 1 such that a pressure in the bottle should be positive, a force is applied which pushes up the cap 5. A force for engaging the cap 5 is weak in a section in which there is only a thread;

therefore, the cap 5 is disposed undesirably upwardly. That is, the cap 5 is disposed partially to the bottle can member 1; thus, a bridge 8*b* is strained in a section in which there is only a thread; thus, the thread is broken. That is, there has been a problem in that a bridge is broken. Also, the thread section 3 is compressed when the cap is put thereon more greatly than in a case in which there are more threads. Therefore, unequal sealing capability occurs in a circumferential direction; thus, there is a concern that there is a reduced airtight condition.

For resolving such a problem, there is a proposal for increasing the effective thread turn number. However, in a step for putting a cap 5 on the bottle can member 1, if a diameter of the cap is approximately 28 mm, the cap is pressed on the bottle by approximately 900 N force so as to wind up the cap therearound. However, if the diameter of the cap is 33 mm or greater, the force in the bottle for pushing up the cap is so great that a greater area for operating a molding operation is necessary. Therefore, the cap is compressed toward a ceiling surface of the bottle can at 1050 to 1200 N force by using a pressure block so as to wind up the cap therearound.

For example, if the effective thread turn number is 2.5 to 3, there are a section in which there are two threads and a section in which there are three threads. Therefore, in a step for molding a cap thread section 7 which is explained above, the section in which there are three threads may be deformed more easily than the section in which there are two threads. In such a case, a relative position between the position for compressing the cap by a thread forming roller and a position of a starting point W1 in a complete thread section W is shifted in an axial direction undesirably; thus, there is a section in which a thread is formed insufficiently. Also, a force is generated for raising a bottom section near a side section of the cap 5 in a axial line direction upwardly; thus, a bridge may be broken more easily if there are more threads. Therefore, if there is a section in which there are three threads, a bridge is broken more easily. In addition, after completing the winding operation for the cap, a pressure block is released. A section in which there are three threads serves as a spring so as to push up the cap. Therefore, a bridge near a section in which there are three threads may be broken more easily than a section in which there are two threads. Also, if the thread turn number is 3 or greater, a torque for opening a cap increases and a number for winding the cap also increases. Therefore, a user have to take more time and efforts for opening a cap accordingly; thus, such a case is not preferable.

If there is not a case in which a bridge is broken in a cap 5 due to an inner pressure of the bottle, an interval therebetween extends if the interval between the cap thread section 7 of the cap 5 and a ceiling surface is long; thus, there is a problem that a contact of the cap decreases. Also, if an interval between the cap thread section 7 of the cap 5 and the ceiling surface is narrow, the mouth section 2 cannot endure a force in a step for compressing the cap 5 thereon; thus, the mouth section 2 may be deformed undesirably.

Also, in a conventional technique, a bottle can which is commonly used for a can for a beverage is produced by a drawing operation by drawing a metal plate which is made of an aluminum and an aluminum alloy and an ironing operation which is supposed to be performed consequently. Such a can is called a DI can commonly. A mouth section is formed on an upper section of the DI can. After filling a content in such a bottle can, a cap is put on the mouth section of the bottle can; thus, a capped bottle can is produced.

Conventionally, a capped bottle can 101 which is shown in FIG. 11 is closed in an airtight manner by putting the cap 103 on the bottle can 102. A male thread section 105, an expanding section 106, and a curl section 107 are formed on the mouth section 104 which is disposed in the bottle can 102. The ceiling surface section 108, a female thread section 109, a pilfer proof section 110, and a bridge section 111 are formed in the cap 103 such that a liner 112 which is a sealing member is applied on an inner surface of the ceiling surface section 108. The cap 103 is attached to the bottle can 102 such that the male thread section 105 of the bottle can 102 and the female thread section 109 fit together and the bottom end section of the pilfer proof section 110 expands over the expanding section 106; thus, the cap 103 is sealed while the curl section 107 and the liner 112 contacts tightly. Also, the capped bottle can 101 has a structure so as to endure a predetermined inner pressure in case that the content thereinside is a carbonated beverage.

In order to open the capped bottle can 101, when the cap 103 is rotated with reference to the bottle can 102, the female thread section 109 is guided by the male thread section 105 so as to be moved upwardly. A bridge section 111 is cut by engaging the expanding section 106 and the pilfer proof section 110; thus, the curl section 107 and the liner 112 are separated. Furthermore, the cap 103 is removed from the bottle can 102 by rotating the cap 103. In such a case, when the cap 103 is rotated for opening the cap 103, a knurl section 113 is formed on the cap 103. The knurl section 113 is formed in an upper section of the female thread section 109 such that concave sections are formed periodically on protruding sections which have arc cross section which are disposed in a circumferential direction.

Also, in a step for winding the cap 103 on the bottle can 102, a cap member on which the female thread section 109 and the pilfer proof section 110 are not formed is applied on the bottle can 102. While a force is applied in a direction in which the cap member is compressed to the bottle can 102, the female thread section 109 and the pilfer proof section 110 are formed along the shape of the male thread section of the bottle can 102 and the shape of the expanding section 106. The curl section 7 and the liner 112 contacts more desirably by winding up the cap 3 while applying a force; thus, a more desirable sealing condition can be realized. In such a case, the effective thread turn number for male thread section and the female thread section 109 is formed to be approximately 1.5 to 1.7.

By the way, in the bottle can 102 to which the above cap 103 is put, if a pressure which is lower than a predetermined inner pressure is applied to the ceiling surface section 108 on the cap 103 and an interval between the female thread section 109 on the cap 103 and the ceiling surface section 108 is long, the interval extends: thus, there is a problem in that a contact between the curl section 107 and the liner 112 may be reduced. Also, a knurl section 113 is formed between the female thread section 109 on the cap 103 and the ceiling surface section 108; thus, there is a problem that the interval extends further.

Also, in order to solve such problems, it is possible to propose an idea in which an interval between the female thread section 109 on the cap 103 and the ceiling surface section 108 should be narrowed; that is, an interval from the male thread section 105 on the bottle can 102 to the upper end surface of the curl section 107 should be maintained in a low position. In such a case, there is a problem in that it bends undesirably because of insufficient rigidity against the pressing force to the cap 103 in a step for putting the cap 103.

Also, the effective thread turn number of the male thread section 105 is approximately to be 1.5 to 1.7; thus, there is a section in which there is a thread and there is a section in which there are two threads from the base end section of the mouth section 104 toward the tip section. Thus, there is a problem in that an engaging force in the male thread section 105 and an engaging force in the female thread section 109 are not constant over a circumferential direction of the mouth section 104. Because of this, even if the inner pressure in the bottle can 102 to which the cap 103 is put is at a predetermined inner pressure or lower, the cap 103 is shifted upwardly undesirably in a section in which there is a thread of which engaging force is weak; thus, there is a problem in that the contact between the curl section 107 and the liner 112 is reduced. Also, if the effective thread turn number is increased to be 2.5 or more so as to enhance the engaging force, there is a problem in that a torque for opening the cap needs to be greater.

Furthermore, in a conventional technique, in a so called bottle can member, a mouth section is formed in an aperture section of the bottle can member which has a bottomed cylindrical shape and a thread section is formed such that the cap should be put around an outer periphery of the mouth section.

In order to produce a bottle can member which has such a thread section, a bottle can member which has a bottomed cylindrical shape is produced in advance. As shown in FIG. 19A, a diameter of the aperture section of the bottle can member is reduced once so as to form a mouth section 202. After that, the diameter is enlarged by a predetermined distance from an end of the aperture end of the mouth section 202 so as to form an enlarged diameter section 202' as shown in FIG. 19B. After that, a thread section 203 is formed at a predetermined distance from the aperture end by a thread forming device as shown in FIG. 19C. In such a case, when the thread section 203 is formed in the mouth section 202, an expanding section 204 is formed by maintaining a diameter enlarged section in which a thread section 203 is not formed.

In the conventional thread forming device, although it is not shown in the drawings, an inner core which contacts an inner surface of the mouth section 202 and an outer core which contacts an outer surface of the mouth section 202 rotate around an axial center of the bottle can member 201 while sandwiching the mouth section 2 with each other; thus, the thread section 203 is formed around an outer surface of the mouth section 202. In such a case, the thread turn number of the thread section 203 which is formed on the mouth section 202 is approximately 1.7 as shown in FIG. 19C.

Also, after that, in the bottle can member 201 on which the thread section 203 is formed, a tip of the mouth section 202 is bent from thereoutside to thereinside. After various steps for putting the cap for forming the curl section 208 as shown in FIG. 20, a content is filled thereinside; thus, the cap 205 is put shown in the drawing so as to seal there.

As explained above, in the conventional thread forming device, an inner core which contacts an inner surface of the mouth section 202 of the bottle can member 201 and an outer core which contacts an outer surface of the mouth section 202 rotate around an axial center of the bottle can member while sandwiching therebetween; thus the thread section 203 is formed which has a thread turn number 1.7 in the mouth section 202 of which diameter is enlarged.

However, if the thread turn number of the thread section is approximately 1.7, as shown in FIG. 20, there is a problem in that there is a section in which there two tread sections 203 on an peripheral surface of the mouth section 202 and there is a section in which there is only one thread section 203; thus, such a difference between the thread sections causes a problem. That is, if there is thread turn number which is explained above, if a pressure in the bottle can member 201 is positive when the cap 205 is put on the bottle can member 201, a pressure which pushes up the cap 205 is applied there; thus, the cap 205 is shifted upwardly undesirably. Therefore, the cap 205 is disposed partially with reference to the bottle can member 201; thus, a bridge 207 which is disposed between scores 206, 206 near the aperture end of the cap 205 is strained and broken. Thus, there is a problem in that there is a so-called a broken bridge.

In order to solve the above problems, it is tried to form a thread turn number 2.2 as shown in FIG. 21 by increasing the thread turn number of the thread section 203. When the thread section 203 which has 2.2 thread turn number on the mouth section 202 of the bottle can member 1 in this way, there is a thread section in which there are a first stage of the thread 203*a*, a second stage of the thread 203*b*, and a third stage of the thread 203*c* for the thread section 203 between the starting section 203A of the thread section 203 and the end section 203B.

By the way, when the thread section 203 which has 2.2 thread turn number is formed on the bottle can member 201 which has a thread area which has the above three threads, after that, a curl section 208 is formed for forming the curl section 208 on a tip of the mouth section 202 in a step for putting the cap while compressing the tip of the mouth section 202 by a cap putting device in a direction which is disposed toward the bottom of the bottle can member.

However, in such a case, the thread section 203 which has three thread sections is disposed; thus, a distance from the first stage of the thread 203*a* to the curl section 208 is close. Therefore, in a step for putting the cap, the first stage of the thread 203*a* of the thread section 203 is crushed because it is compressed downwardly by a compressing force by the cap putting device. Therefore, as shown in FIG. 22, a diameter of the first stage of the thread 203*a* is enlarged in a radial direction such that the first stage of the thread 203*a* protrude by Δ from a height of the second stage of the thread 203*b* and the third stage of the thread 203*c* in a circumference direction undesirably.

If the first stage of the thread 203*a* of the mouth section 202 is protruding in a circumferential direction ad the cap 20 is put on the bottle can member 201 consequently, the cap 205 is put thereon according to a shape of the mouth section 202; therefore, as shown in FIG. 22, a diameter of the aperture of the cap 205 is smaller than the outer diameter of a bottle thread 203*a*. Here, the cap 5 is shown in FIG. 22 under condition that a part of the cap 5 is broken.

The cap 205 which is put thereon under the above explained condition is removed from the bottle can member 201 such that the user can use it for drinking a content therein. Also, the mouth section 202 can be screwed so as to seal the mouth section when the user stops drinking the content therein. However, if the diameter of the end of the aperture of the cap is smaller than the diameter near the ceiling, a resistance between the mouth section 202 and the cap 205 is so great that a larger torque for closing the cap is necessary. Thus, there is a problem in that it is sometimes hard for handling it.

SUMMARY OF THE INVENTION

The present invention was made in consideration of the above problems. An object of the present invention is to provide a bottle can member and a bottle to which a cap is put in which a bridge should not be broken on the cap which is put on the mouth section of the bottle can member such that it is possible to put the cap desirably.

Also, other object of the present invention is to provide a metal bottle can which has a folding rigidity in which the mouth section of the metal bottle can be sealed by the cap reliably.

Furthermore, other object of the present invention is to provide a method for forming the mouth section of the bottle can member in which it is possible to form all thread sections of the mouth section approximately equally with regardless to the steps for putting the cap. Yet, other object of the present invention is to provide a method, a bottle can member, and a bottle for forming the mouth section of the bottle can member in which it is possible to perform the above method reliably.

In order to achieve the above objects, the present invention proposes devices and methods below.

An invention according to a first aspect of the present invention is characterized to be a bottle can member in which a thread section is formed in a mouth section of a metal bottle can member which has a bottomed cylindrical shape such that an outermost diameter of the thread section which is formed on the mouth section is 28 to 38 mm, a thickness there is 0.25 to 0.4 mm, and an effective thread turn number of the thread section is formed to be 2.0 to 2.5.

According to the bottle can member of the present invention, the effective thread turn number of the thread section of the mouth section is 2.0 to 2.5; therefore, if the cap is put on the bottle can member, the bridge is not broken, nor an insufficient thread section is not formed. In addition, the torque for opening the cap and the rotating number for the cap do not increase unnecessarily; thus, the cap is put desirably. More preferably, if the thread section is formed such that the thread turn number is 2.0 to 2.3, the cap is put more preferably. It is because incomplete thread sections Y, A overlap in an axial direction if the effective thread turn number is smaller than 2.0; thus, it is not possible to form the thread stably. Also, by forming the effective thread turn number by 2.0 to 2.5, a compressing amount for the mouth section in an axial direction when the cap is put is approximately equal over a circumferential direction; thus, it is possible to enhance a sealing condition. Here, it is more preferable if an outermost diameter of the thread section is 31 to 38 mm.

The invention according to a second aspect of the present invention is a bottle can member of the first aspect in which the thread section which is formed on the mouth section of the bottle can member is formed in a pitch of eight-thread per inch.

According, to the bottle can member according to the present invention, the thread section of the mouth section is formed by a pitch such as the eight-thread per inch; thus, it is possible to form a desirable thread section for such type of the bottle can member.

The invention according to a third aspect of the present invention is a bottle can member according to the first or the second aspect in which, under condition that an outer diameter of the thread which passes through a thread start point is indicated by D1, and an outer diameter of a curl section which passes through the outermost diameter section of the curl section is indicated by D2, a height h from the thread start point of the thread section to an upper end surface of the mouth section is in a range of $0.7 \leqq (D1-D2)/h \leqq 1$.

According to the bottle can member of the present invention, under condition that an outer diameter of an outer diameter of the thread which passes through the start point is indicated D1, and an outer diameter of a curl section which passes through the outermost diameter section of the curl section is indicated D2, the mouth section is formed such that the height h from the thread start point of the thread section to an upper end surface of the mouth section should be in a range of $0.7 \leqq (D1-D2)/h \leqq 5.1$, a length of an interval between the female thread section of the cap and the ceiling surface and an outer diameter of the cap are specified so as to correspond to the formed mouth section. Therefore, the interval between the female thread section of the cap and the ceiling surface hardly extend due to an inner pressure of the bottle can to which the cap is put. Furthermore, it is preferable that the mouth section should be formed such that the height h should be in a range of $3.24\ \text{mm} \leqq h \leqq 5.6\ \text{mm}$ so as to restrict such an extension. By doing this, it is possible to maintain the contact between the bottle can member and the cap desirably.

The invention according to a fourth aspect of the present invention is characterized to be a bottle can member of the first to the third aspect in which the slant angle θ in the slant section is set to be in a range of $33° \leqq \theta \leqq 55°$.

According to the bottle can member according to the present invention, the mouth section is formed such that the slant angle θ of the slant section which is disposed upwardly from the thread start point of the thread section to an upper section above the mouth section should be $33° \leqq \theta \leqq 55°$. Therefore, the mouth section is formed so as to endure the compressing force by the cap in the step for putting the cap. By doing this, it is possible to form a bottle can member which has a high folding rigidity.

The invention according to a fifth aspect of the present invention is characterized in that the cap is put on the mouth section of the bottle can member according to the first to the fourth aspect.

According to the bottle of the present invention, the effective thread turn number of the cap thread section is formed to be 2.0 to 2.5; thus, the bridge is not broken. Thus, the cap is put on the bottle can member desirably.

The invention according to a sixth aspect of the present invention is characterized in that, in a method for forming a mouth section of the bottle can member for forming a thread section which has a plurality of stages of the thread from a tip of the mouth section toward a direction of a can bottle, a height of the first thread which is disposed near the tip of the mouth section of the bottle can member should be formed lower than the height of other stages of the thread in a predetermined angle range when the thread section is formed.

According to a method for forming the mouth section of the bottle can member according to the present invention, when the thread section is formed, if the height of the first thread which is disposed near the tip of the mouth section of the bottle can member is formed to be lower than the other stages of the thread in a predetermined angle range, when the bottle can member is compressed in a step for putting the cap under this condition, the first thread is compressed to be crushed; thus, the diameter is enlarged. Therefore, the height of the first thread is approximately equal to the height of the other thread; thus, it is possible to form all the stages of the thread desirably.

The invention according to a seventh aspect of the present invention is characterized to be a method for forming the mouth section of the bottle can member according to a second aspect of the present invention in which a predetermined angle range is within 90 degrees from the thread start point of the thread section.

According to a method for forming the mouth section of the bottle can member according to the present invention, the height of the first thread is lower than the height of the other thread with in a range of 90 degrees from the thread start point of the thread section; therefore, it is possible to cover the first thread reliably in a range where the thread is crushed such that the diameter should be enlarged by a compressing force in a step for putting the cap.

The invention according to an eighth aspect of the present invention is a thread forming device which comprises a core which contacts an inner surface of a mouth section of the bottle can member and has a thread forming section for disposing a thread section which is supposed to be formed in the mouth section on an outer periphery, and an outer member which contacts the outer periphery of the mouth section and has a thread forming section which has a corresponding shape to the thread forming section of the core around the outer periphery such that the core and the outer member rotate around an axial center of the bottle can member while sandwiching the mouth section, a thread forming section which forms a first thread in the thread area in the mouth section is formed lower than the other thread forming section in a predetermined angle range.

According to the thread forming device according to the present invention, the first thread forming section of the core is formed so as to be lower than the other stage of the thread forming section in a predetermined angle range; therefore, it is possible to form the first thread to be lower than the other stage of thread on an outer periphery of the mouth section of the bottle can member reliably.

An invention according to a ninth aspect of the present invention is characterized in that, in a bottle can member in which a mouth section is disposed in an aperture section and a thread section is formed having a thread turn number which has a thread area which has a plurality of stages on an outer periphery of the mouth section, the height of the first thread in the thread area in the tread section is formed so as to be lower than the height of the thread in the other stage in a predetermined angle range.

According to the bottle can member according to the present invention, the height of the first thread which is disposed on the mouth section is formed so as to be lower than the height of the thread in the other stage in a predetermined angle range; therefore, if a diameter of the mouth section is enlarged in a step for putting the cap, it is possible to dispose the height so as to be equal approximately to the height of the thread in the other stage.

An invention according to a tenth aspect of the present invention is a bottle can member which is characterized in that, in a area which is except an area which overlaps the plurality of stages and an incomplete thread section in the thread end section, a mouth section is disposed in the aperture section, and a thread section which has a thread turn number such that the thread area is formed so as to have a plurality of stages of thread areas from the tip of the mouth section toward a direction of a bottom of the can, and the height of the first thread in the thread section is formed so as to be lower than the height of the second thread.

According to the bottle can member according to the present invention, the height of the first thread is formed so as to be lower than the height of the second thread; therefore, if the diameter of the mouth section is crushed by a compressing force in a step for putting the cap, the heights of the threads can be formed so as to be approximately equal respectively.

An invention according to an eleventh aspect of the present invention is characterized in comprising a bottle can member and a cap which is put on a mouth section of the bottle can member.

According to the bottle according to the present invention, the height of the thread in the thread section which is disposed on the mouth section is approximately equal to the height therearound; therefore, if the cap is put there, the cap is not depositioned due to a positive pressure in the bottle can member, nor the bridge is not broken. In addition, it is possible to obtain a desirable bottle by which it is possible to put and detach the cap smoothly.

DETAILED DESCRIPTION OF THE INVENTION

Preferable embodiments for A metal bottle can, a thread forming device, and a method for forming a mouth section are explained below with reference to drawings. However, the present invention is not limited to the embodiments below; thus, for example, it may be acceptable if structural elements in these embodiments may be combined appropriately.

Figure 1:
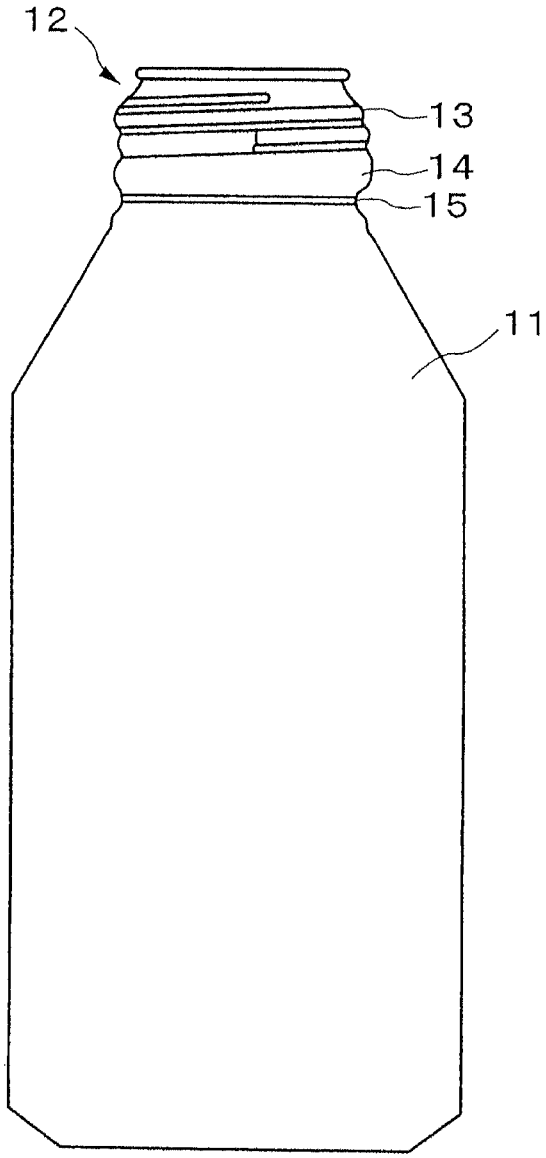
FIG. 1 is a general view for a bottle can member according to a first embodiment of the present invention.
Figure 2B:
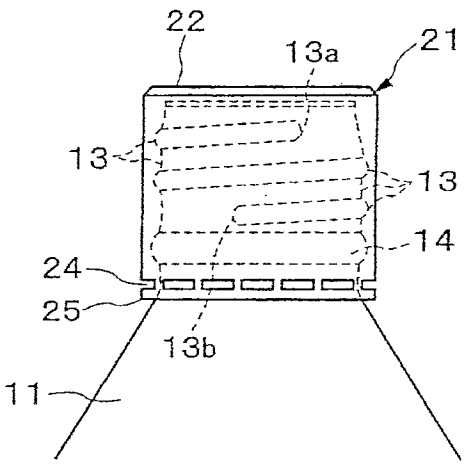
FIG. 2B provides an view of the bottle can member and a cap of FIG. 2A, in which the cap is fastened to the mouth section of the bottle can member.
Figure 2A:
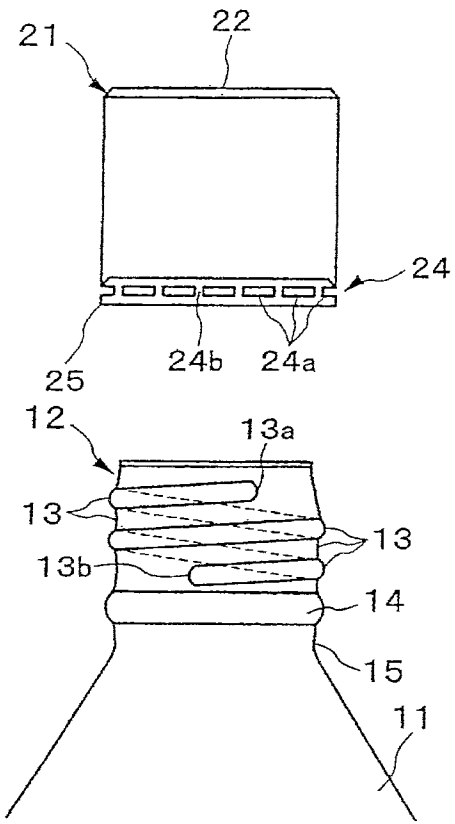
FIG. 2A provides an exploded view of the bottle can member of FIG. 1 and a cap which may be fastened to a mouth section of the bottle can member.
Figure 3:
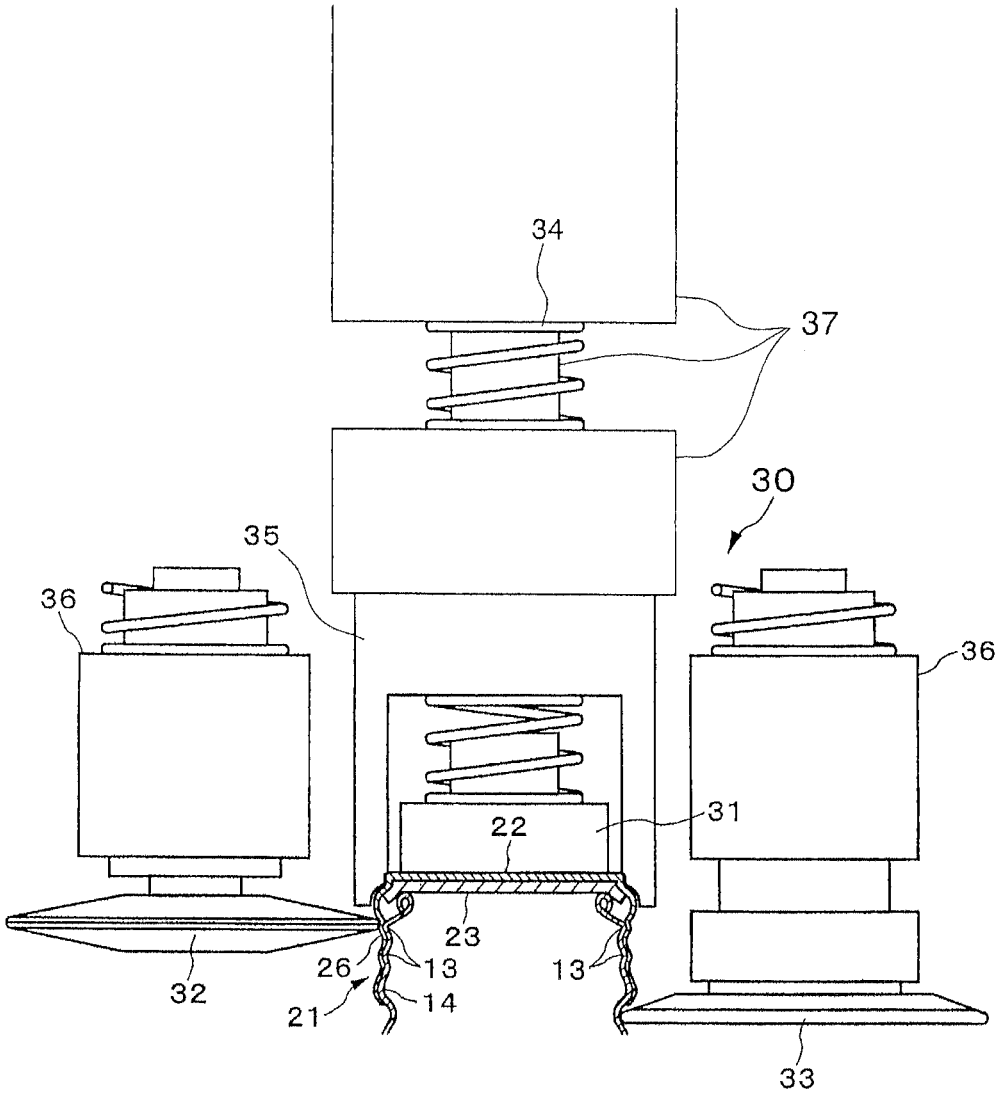
FIG. 3 is a cross section for explaining the cap which is put on the bottle can member.
Figure 4:
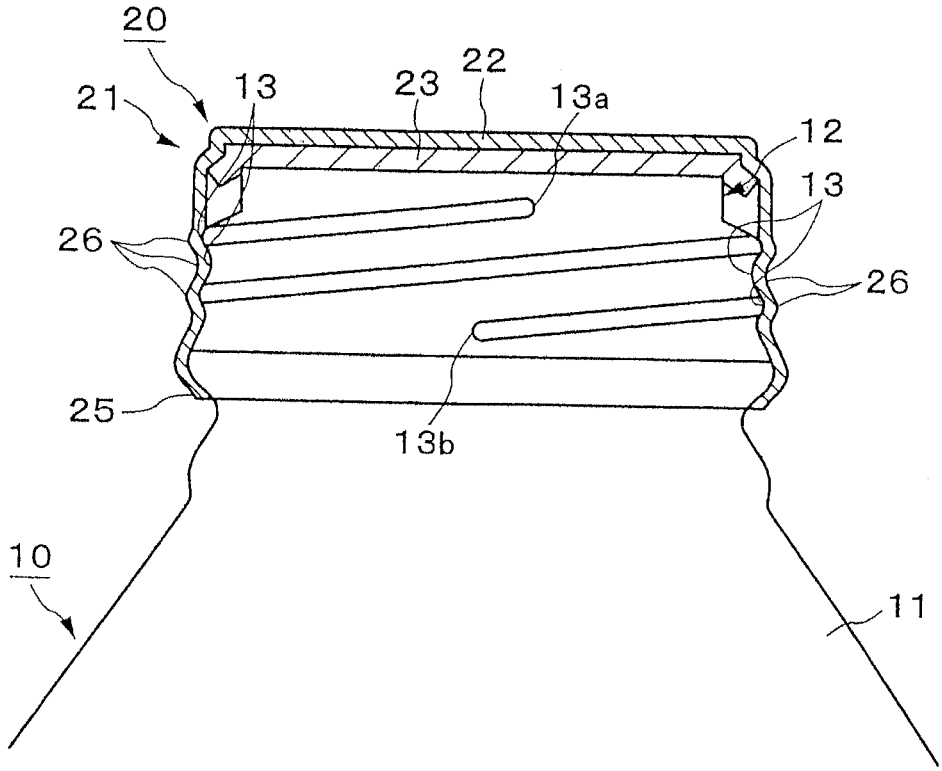
FIG. 4 is an enlarged view for explaining a bottle in which the cap is put on the bottle can member.
Figure 5:
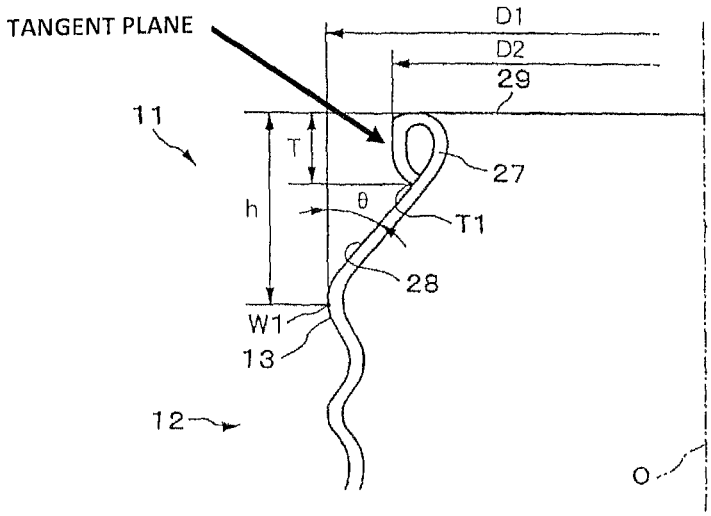
FIG. 5 is an enlarged cross section for a mouth section of the bottle can member.

Hereinafter, the embodiments of the present invention are explained with reference to the drawings. FIGS. 1 to 5 are views for showing a bottle can member according to the first embodiment and a bottle in which a cap is put on the bottle can member. FIG. 1 is a view for showing an entire bottle can member. FIGS. 2A and 2B illustrate a relationship between the bottle can member and the cap. FIG. 3 is a cross section for explaining steps for putting the cap on the bottle can member. FIG. 4 is an enlarged view for showing the bottle in which the cap is put on the bottle can member. FIG. 5 is an enlarged cross section for the mouth section of the bottle can member.

The bottle can member 11 according to the present embodiment serves for filling a carbonated beverage and a fruit beverage thereinside which is made of an aluminum member or an aluminum alloy such that the mouth section 12 is formed on an upper section of the bottle can member 11 as shown in FIG. 1.

Figure 7A:
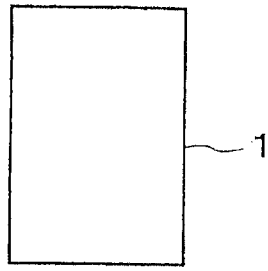
FIGS. 7A to 7D are views for conventional thread sections which are formed on the mouth section of the bottle can member.
Figure 7B:
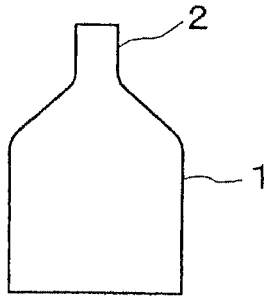
Figure 7C:
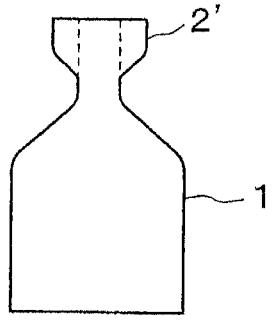
Figure 7D:
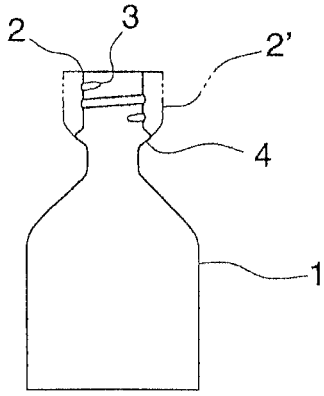

A thread section 13 is disposed on an upper outer periphery of the mouth section. An expanding section 14 is formed so as to be lower than the thread section 13. Simultaneously, a neck section 15 is formed therebeneath. The thread section 13 is formed such that a diameter of the mouth section 12 which is disposed on the bottle can member 11 is enlarged so as to form the enlarged-diameter section, and after that a diameter of a portion in which the thread is supposed to be formed is decreased, a thread is formed by a thread forming device (which is not shown in the drawings) on such a diameter-decreased section. The diameter of the expanding section 14 is not decreased and furthermore the expanding section 14 is disposed at the diameter-enlarged section in which a thread is not formed when the thread-forming process is performed on the thread section 13 (See FIG. 7D).

In addition, when a cap member 21 which is formed in a bottomed cylindrical shape as shown in FIG. 2A covers the mouth section 12, the cap 20 is put on the mouth section 12 as shown in FIGS. 2B and 4 by winding up the cap member 21 by a capping device 30 as shown in FIG. 3. By doing this, the cap 20 seals an end of the aperture in the mouth section 12.

An upper section of the cap member 21 is closed by a ceiling plate 22 as shown in FIG. 2A before it is put thereon. Simultaneously, a lower section has a cylindrical shape which has an aperture orthogonally so as to be disposed downwardly. A liner 23 (See FIGS. 3 and 4) is attached in an inner surface of the ceiling plate 22. A cap main body lower section 25 is disposed on a lower end of the cap member 21 via a bridge section 24. A plurality of scores 24*a* and a bridge 24*b* are disposed in the bridge section 24 alternately in a circumferential direction of the cap member 21.

In the present embodiment, an effective thread turn number in the thread section 13 which is disposed on the mouth section 12 of the bottle 11 is formed to be 2.2. That is, the thread section 13 is formed such that, when a diameter-enlarged section is formed in the mouth section 12, a threading roller of the thread forming device moves rotatively along a circumference of an enlarged-and-decreased-diameter section. Such an enlarged-and-decreased-diameter section is compressed so as to form a thread peak and a thread valley separately. In such a case, as shown in FIGS. 2 and 4, the effective thread turn number between a start position 13*a* and an end position 13*b* which serve effectively for the thread section 13 is formed to be 2.2 in the mouth section 12. Here, in the present invention, it is acceptable if the effective thread turn number is 2.0 to 2.5.

Figure 6A:
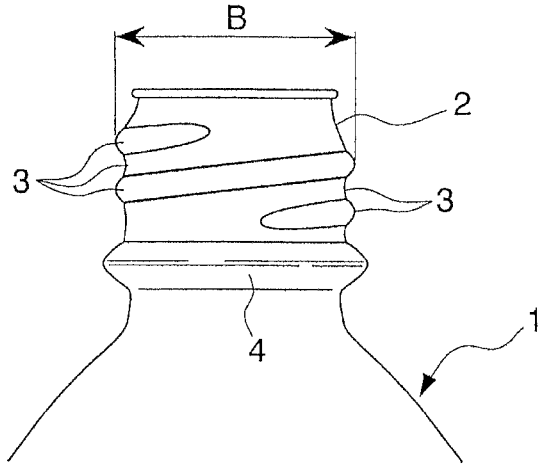
FIGS. 6A to 6C are views for explaining a conventional bottle can member and the cap.
Figure 6B:
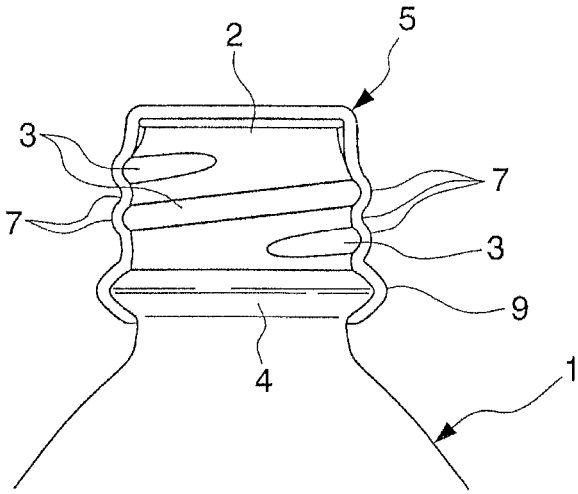
Figure 6C:
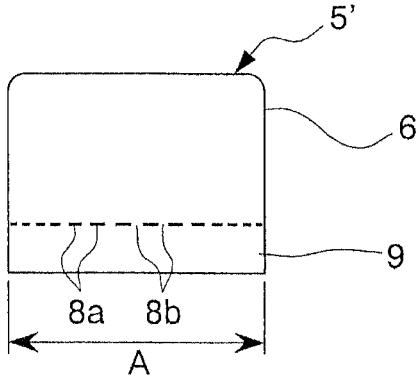
Figure 8:
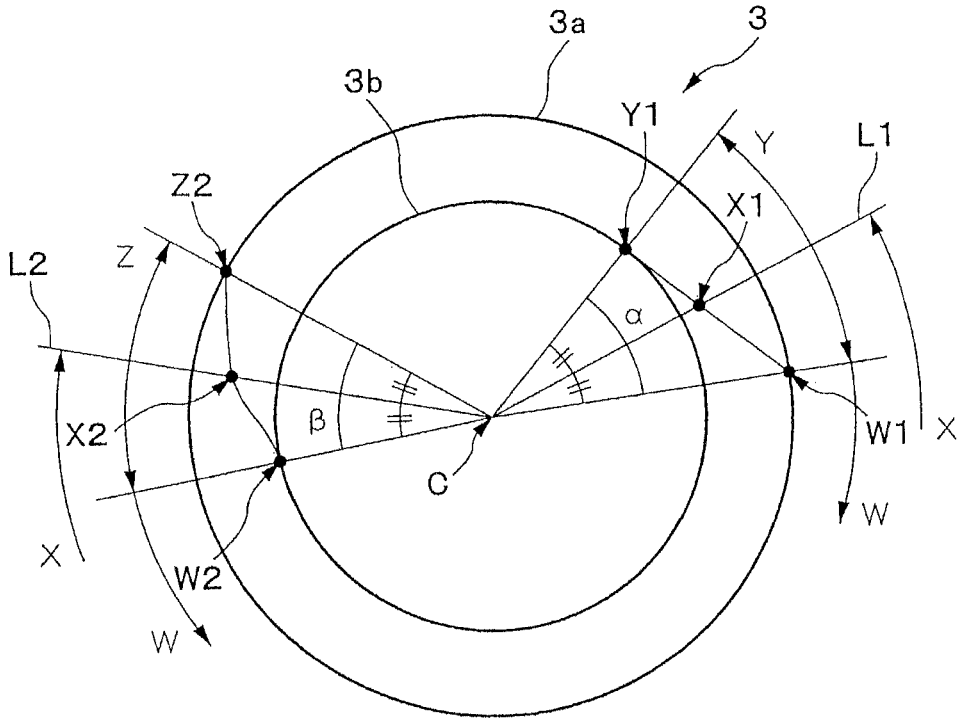
FIG. 8 is a view for explaining an effective conventional thread section.

The effective thread section in the thread section 13 is defined similarly to the effective thread section which is shown in a conventional example as shown in FIGS. 6A to 6C such that the thread section covers from the start position 13*a* (an effective thread start point X1 in FIG. 8) to the end position 13*b* (an effective thread end point X2 in FIG. 8). Also, an outer diameter of the thread section of the mouth section 12 is defined similarly to the outer diameter B which is shown in FIG. 6*a* which shows a conventional example. In the bottle can member 11 which has such a thread section 13, an outermost diameter of the thread section 13 which is formed on the mouth section 12 is 28 to 38 mm. Also, the thickness of the mouth section 12 is 0.25 to 0.4 mm. The thread section 13 which has the effective thread turn number 2.2 is formed by eight-thread per inch pitch.

Therefore, if the cap member 21 is put on the mouth section 12 as shown in FIG. 2B and the cap 20 is put around an outer periphery of the cap member 21 by forming the cap thread section 26 by using a capping device 30 as shown in FIG. 3, a thread section which has the effective thread turn number 2.2 is formed on the cap 20.

Also, as shown in FIG. 5, a curl section 27 of which tip is bent outwardly is formed on a tip of the mouth section and a slant section 28 of which diameter is enlarged toward downwardly from the curl section 27 are formed. The thread start point W1 (See FIG. 8) serves a point which is an approximate outermost diameter for the thread section 13. An outer diameter which passes through the thread start point W1 is indicated by D1. An outer diameter which passes through an outermost diameter section of the curl section 27 is indicated by a curl section outer diameter D2. Also, h indicates a thread start point height between an upper end surface 29 of the bottle can member 11 and the thread start point W1. T indicates a curl section height between the upper end surface 29 and the lowest end point T1 which is disposed outside of the curl section 27.

With reference to FIG. 5, it can be seen that the outermost diameter section of the curl section 27 at the diameter D2 extends vertically in a linear direction that is substantially parallel to a central axis O. As a result, it is evident that linear vertical portion of the outermost diameter section of the curl section 27 defines a tangent plane that is substantially parallel to the central axis O.

The slant angle θ of the slant section 28 is an angle which is formed by an inclination which is disposed toward an upper section of the mouth section from the thread start point W1 and the central axis O. An average angle for the slant section 28 between the lowest end point T1 which is disposed outside of the curl section 27 and the thread start point W1 is used for such a slant angle θ.

The slant angle θ is measured by using a contracer CDH-400 (a product of Mitutoyo Corporation, trademark registered) such that a predetermined section from the thread start point W1 to the lowest end section T1 is measured. That is, a contour shape of the slant section 28 is measured in a direction O for the central axis by the contracer such that a line is determined by using a least square method according to the measured contour shape under condition that a slant angle θ is formed by the line and the central axis O.

Also, there is a relationship which is indicated by a formula F1 between the above explained slant angle θ and the thread start point height h.

$$h \approx \tan(90-\theta)\frac{(D1-D2)}{2}+T \qquad \text{Formula F1}$$

It is understood that, according to the Formula F1, when an outer diameter D1 of the thread, an outer diameter D2 of the curl section, and the height T of the curl section are fixed, the thread start point height h is determined if the slant angle θ is determined, and the thread start point height h is decreased if the slant angle θ is increased. By doing this, the lower limit of the slant angle θ is an upper limit for the thread start point height h. The lower limit for the thread start point height h is an upper limit for the slant angle θ. It is acceptable if a range for h is $0.7 \leqq (D1-D2)/h \leqq 1.3$. More preferably, the range for the h should be $3.24 \leqq h \leqq 5.6$ mm.

As mainly shown in FIG. 3, the capping device 30 is provided with a pressure block 35 which compresses the ceiling plate 22 of the cap member 21 which covers the bottle can member 11 downwardly, an RO roller 32 which compresses the cap member 21 to the mouth section 12 from a periphery therearound and forms the cap thread section 26 by winding the outer periphery of the cap member 21 along the thread section 13 of the mouth section 12, and a PP roller 33 which forms a pilfer proof section by winding the cap member body lower section 25 of the cap member 21 around a lower part of the expanding section 14 from an outer periphery.

Here, the compressing member 35 is provided with a compressing member 31 which compresses the ceiling plate 22 of the cap member 21 so as to be connected to a pressure shaft 37 via a compressing spring member 34 such that when the cap 20 is put, a compressing force for compressing the ceiling plate 22 of the cap member 21 which covers the mouth section 12 can be varied according to a size of the diameter of the mouth section 12. The RO roller 32 and the PP roller 33 are rotative around the bottle can member 11 and the cap member 21 by a supporting arm 36.

In the bottle can member 11 according to the present embodiment, as explained above, the effective thread turn number of the thread section 13 which is disposed in the mouth section 12 is formed to be 2.2. The cap 20 is put there; therefore, a shown in FIGS. 2A and 2B, the cap member 21 which has a bottomed cylindrical shape is disposed so as to cover thereon. After that, the capping device 30 is driven. While the pressure block 35 of the capping device 30 compresses the cap member 21 as shown in FIG. 3 in a direction toward the bottom section of the bottle can member 11 and the RO roller 32 is rotated along a periphery of the mouth section 12 so as to trace the thread section 13 of the bottle can member 11. By doing this, as shown in FIG. 4, a cap thread section 26 is formed which corresponds to the thread section 13 of the mouth section 12 on an outer periphery of the cap member 21. Also, the cap main body lower section 25 of the cap member 21 is wound around the expanding section by the PP roller 33. By doing this, the cap 20 is put on the bottle can member 11.

A load test and a leak test are performed by using the above explained bottle can member 11 and the cap 20. The experiment is performed for three variations for the bottle can members 11 and the caps 20 which have 38 mm size, 33 mm size, and 28 mm size while varying the slant angle θ and the thread start point height h. For the experiment, the bottle can member 11 is used which has 0.24 to 0.4 mm thickness, an effective thread turn number 2.2 for an eight-pitch-per-inch which is disposed for the thread section. A cap 20 to which a liner 23 is attached which is made of a polyethylene member or a polypropylene member is used which has a tension strength such as 180 to 230 N/mm$^2$, 0.25 mm thickness.

In the load test, a force is applied gradually in an axial direction of the bottle can member 11. If the bottle can member 11 is folded by a force which is under 1600 N, it is evaluated as "unacceptable" (X). If the bottle can member 11 is folded by a force which is over 1600 N, it is evaluated as "acceptable" (○). In the leak test, the weight of the bottle 10 is measured which is filled by 0.1 Mpa of inner pressure under an ordinary temperature condition such that the weight is measured under an ordinary temperature condition after maintaining the bottle 10 for an entire daytime under 37° C. condition. If the difference of the weight is under 0.2 mg, the bottle 10 is evaluated as "acceptable" (○). If the difference of the weight is over 0.2 mg, the bottle 10 is evaluated as "unacceptable" (X). Results of the experiments are shown in TABLE 1.

TABLE 1

| | h | θ | Evaluation for Folding | Evaluation for leaking | Total Evaluation |
|---|---|---|---|---|---|
| ϕ 38 can | 3.2 | 62.0 | X | ○ | X |
| D1 = 38 mm | 3.6 | 55.0 | ○ | ○ | ○ |
| D2 = 33.4 mm | 4.6 | 40.0 | ○ | ○ | ○ |
| T = 2 mm | 5.6 | 33.0 | ○ | ○ | ○ |
| | 6.0 | 29.0 | ○ | X | X |
| ϕ 33 can | 3.18 | 56.1 | X | ○ | X |
| D1 = 33 mm | 3.24 | 54.6 | ○ | ○ | ○ |
| D2 = 29.5 mm | 3.61 | 47.4 | ○ | ○ | ○ |
| T = 2 mm | 4.68 | 33.2 | ○ | ○ | ○ |
| | 4.74 | 32.5 | ○ | X | X |
| | 5.54 | 26.3 | ○ | X | X |
| ϕ 28 can | 3.2 | 59.0 | X | ○ | X |
| D1 = 28 mm | 3.4 | 55.0 | ○ | ○ | ○ |
| D2 = 24.0 mm | 3.6 | 51.0 | ○ | ○ | ○ |
| T = 2 mm | 4.6 | 37.0 | ○ | ○ | ○ |
| | 5.1 | 33.0 | ○ | ○ | ○ |
| | 5.6 | 29.0 | ○ | X | X |

It is understood that, in the TABLE 1, if the thread start point height h becomes short; that is, if the slant angle θ becomes larger, there occurs a folding, and if the thread start point height h becomes long; that is, if the slant angle θ becomes smaller, there occurs a leaking. By doing this, the range for the thread start point height h and the slant angle θ in which there do not occur a folding or a leaking is evaluated as ○, and the rest of them are evaluated as X. For ranges which is evaluated as ○ in the total evaluation are such that $3.6\text{ mm} \leqq h \leqq 5.6\text{ mm}$ and $33.0° \leqq \theta \leqq 55.0°$ in a bottle 10 which has 38 min of an outer diameter D1 of the thread, $3.24\text{ mm} \leqq h \leqq 4.74\text{ mm}$ and $32.5° \leqq \theta \leqq 54.6°$ in a bottle 10 which has 33 mm of an outer diameter D1 of the thread, and $3.4\text{ mm} \leqq h \leqq 5.1\text{ mm}$ and $33.0° \leqq \theta \leqq 55.0°$ in a bottle 10 which has 33 mm of an outer diameter D1 of the thread.

As explained above, the bottle 11 according to the present embodiment is formed so as to have the effective thread turn number of the thread section 13 which is disposed on the mouth section 12 to be 2.2. Therefore, there the bending section of the thread section 13 is not disposed partially due to a pressure of the pressure block in a step for putting the cap 20. By doing this, the height positions for compressing the RO roller to the cap 20 are not unequal; thus, there does not occur a defect thread. Also, there are less sections in which there are three threads; thus, the bridge is hardly broken when the cap 20 is put thereon.

On the other hand, if the cap 20 is put on the bottle can member 11 and a pressure inside the bottle 10 is positive, a force which pushes the cap 20 from thereinside of the mouth section 12 of the bottle can member 11. As explained above, the effective thread turn number for the thread section 13 of the mouth section 12 and the cap thread section 26 are 2.2 such that the thread section 13 and the cap thread section 26 are engaged by a constant force. Thus, the cap 20 is not disposed to the bottle can member 11 partially; thus, there is not a concern in that the bridge section 24 of the cap 20 may be broken. Also, the torque for opening the cap does not increase unnecessarily.

As a result, according to the present embodiment, it is possible to put the cap 20 on the bottle can member 11 desirably; thus, it is possible to maintain a desirable condition for the cap 20 after it is put thereon. Therefore, it is possible to solve a conventional problem which is caused by the thread turn number of the thread section 13 of the bottle can member 11; therefore, it is possible to enhance a reliability of the bottle 10.

Also, the bottle can member is formed so as to be in a range of the thread start point height h such as $3.24 \leqq h \leqq 5.6$ mm; therefore, it is possible to obtain a desirable contact between the curl section 27 and the liner 23 under a predetermined inner pressure. That is, the interval between the cap thread section 26 of the cap 20 and the ceiling plate 22 extends due to the inner pressure. Such an extension amount is determined by the thread start point height h; thus, it is possible to set the extension amount in which there is not a leaking by setting the thread start point height h within the above range. By doing this, it is possible to form the bottle can member 11 which has a desirable sealing condition under a predetermined inner pressure condition.

Also, the slant angle θ is formed so as to be in a range of $33° \leqq \theta \leqq 55°$, thus, it is possible to a load resistance which can endure the force for compressing the cap 20 in a step for putting the cap 20. Also, the mouth section 12 is formed so as to have the effective thread turn number to be 2.0 to 2.5, thus, the cap 20 is not disposed to be shifted undesirably; therefore, it is possible to form the bottle can member 11 to which the cap 20 is put reliably and restrict the increase in the torque for opening the cap.

Here, in the embodiments shown in the drawings, an example is shown in which the effective thread turn number is 2.2 which is formed in the thread section 13 which is formed in the mouth section 12 of the bottle can member 11 and the cap 20. It is acceptable if the effective thread turn number is at least 2.0 or higher to be lower than 2.5. Furthermore, as long as the effective thread turn number is 2.0 to 2.3, the incomplete thread section does not overlap in an axial direction; thus, it is possible to form the thread. Therefore, there are less sections in which there are three threads; thus, it is preferable.

Therefore, in the present invention, if the outermost diameter of the thread section 13 which is formed on the mouth section 12 of the bottle can member 11 is 28 to 38 mm, the thickness thereof is 0.25 to 0.4 mm, and the effective thread turn number is 2.0 to 2.5, more preferably 2.2 to 2.3, it is possible to realize the above operational effects.

Hereinafter, the embodiments of the present invention are explained with reference to the drawings.

Figure 9:
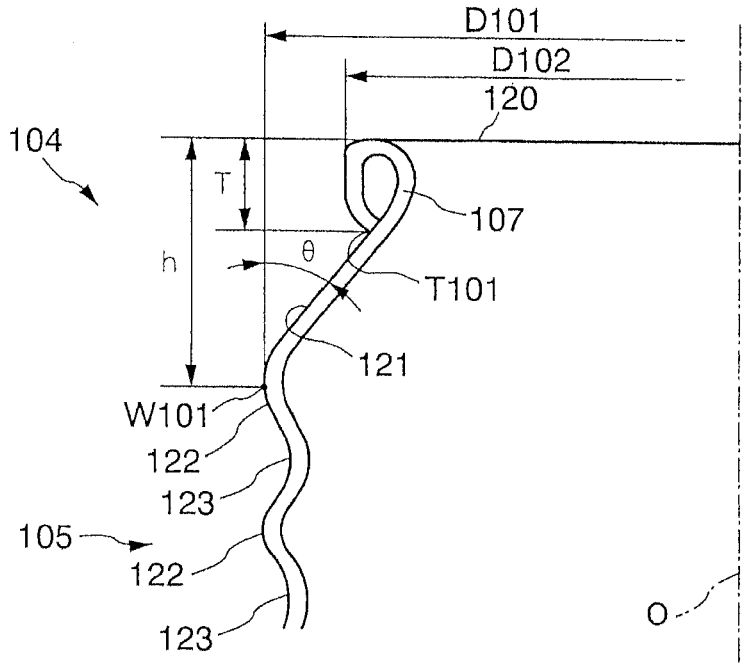
FIG. 9 is a cross section for showing an important part of the mouth section of a metal bottle can member according to the first embodiment of the present invention.

A partial cross section for a mouth section of a metal bottle can is shown in FIG. 9. In the mouth section of the metal bottle can (hereinafter called a bottle can for short) 104, the tip is folded outwardly so as to dispose the curl section 107 such that a surface which is disposed in an uppermost on a curved surface which forms the curl section 107 is an upper end surface 120. A slant section 121 is disposed of which diameter increases toward downwardly from the curl section 107; thus, a male thread section 105 is disposed which has a thread peak 122 and a thread valley 123 beneath the slant section 121.

Also, a part of the slant section 121 protrudes gradually toward a circumferential direction on an upper end section of the male thread section 105. The protrusion height increases until reaching the predetermined height of the thread 122. Thus, the thread start end section is formed such that the depth of the thread valley 123 decreases gradually toward the circumferential direction in a lower end section of the male thread section 105; thus, the thread end section is formed.

In a cross section which is shown in FIG. 9, the thread start point W101 serves a point which is an approximate outermost diameter of the thread 122 under condition that the outer diameter D101 of the thread indicates an outer diameter which passes through the thread start point W101 and an outer diameter D102 of the curl section indicates an outer diameter which passes through the outermost section of the curl section 107. Also, h indicates a thread start point height between an upper end surface 120 of the bottle can member 102 and the thread start point W101. T indicates a curl section height between the upper end surface 120 and the lowest end point T101 which is disposed outside of the curl section 107.

The slant angle θ of the slant section 121 is an angle which is formed by an inclination which is disposed toward an upper section of the mouth section from the thread start point W101 and the central axis O. An average angle for the slant section between the lowest end point T101 which is disposed outside of the curl section 107 and the thread start point W101 is used for such a slant angle θ.

The slant angle θ is measured by using a contracer CDH-400 (a product of Mitutoyo Corporation, trademark registered) such that a predetermined section from the thread start point W101 to T101 is measured.

Also, there is a relationship which is indicated by a formula F1 between the above explained slant angle θ and the thread start point height h.

Here, the outer diameter D101 of the thread in the present embodiment corresponds to the outer diameter D1 of the thread in the first embodiment. The outer diameter D102 of the curl section corresponds to the outer diameter D2 of the curl section of the first embodiment. The thread start point W101 corresponds to the thread start point W1 of the first embodiment. The lowest end point T101 corresponds to the lowest end point T1 of the first embodiment.

Figure 10:
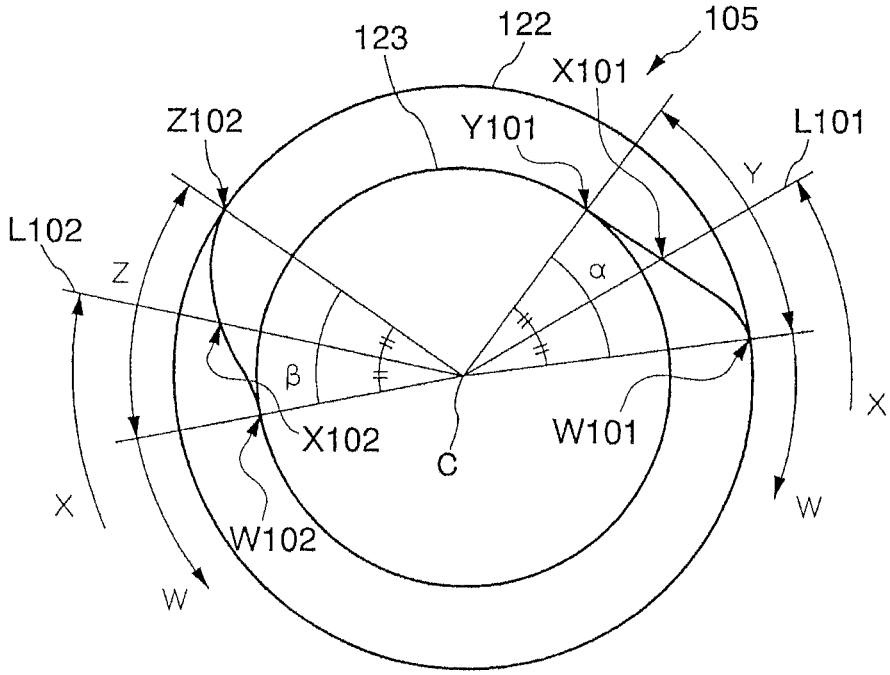
FIG. 10 is a view for explaining a thread winding section by viewing a male thread section upwardly.
Figure 11:
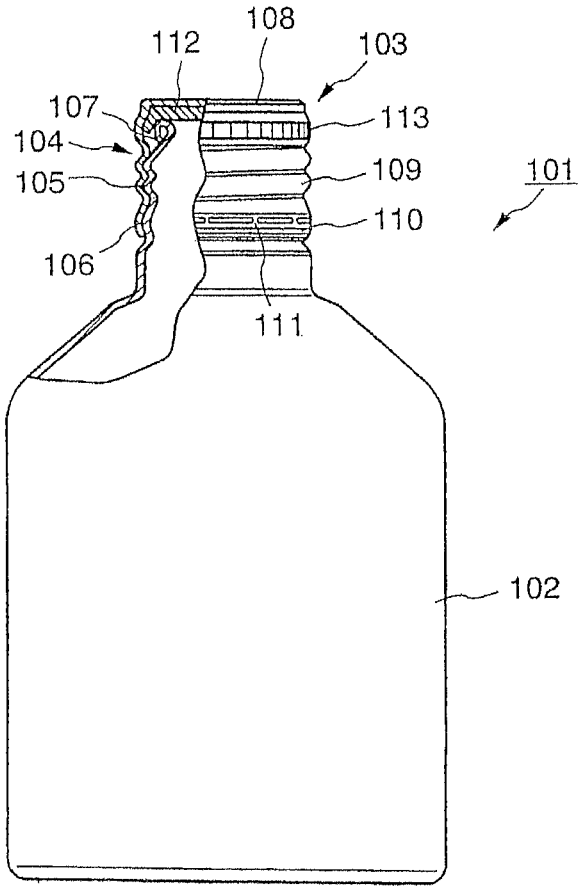
FIG. 11 is a cross section for a part of a conventional metal bottle can to which a cap is put.

Also, the thread start end section Y, the thread end section Z, and the effective thread winding section X are explained by using the drawing in which the male thread section 105 is viewed upwardly which is shown in FIG. 10. The depths for the thread peak 122 and the thread valley 123 for the thread start end section Y and the thread end section Z are not constant in a circumference direction; thus, it is an incomplete thread section. In contrast, the perfect thread section W is formed so as to have a predetermined thread height and the thread depth. The incomplete thread in the thread start end section Y is formed so as to protrude from the end point Y101 of the thread start end section Y so as to be higher gradually at the thread start point W101 of the perfect thread section W at the predetermined height of the thread 122. Also, the incomplete thread valley in the thread end section Z is formed so as to have a depth which should be shallower from the thread end point W102 of the perfect thread section W and the depth disappears at the end point Z102 of the thread end section Z; thus, it is a plain surface.

The effective thread section X includes all the sections from the effective thread start point X101 in the middle of the thread start end section Y, the perfect thread section W so as to be a thread section which covers the effective thread end point X102 which is in the middle of the thread end section Z. The effective thread start point X101 is a cross section which is formed by a bisector L101 which is formed in an acute angle ∠α of the thread start end section Y which is formed by the end point Y101, the center point C, and the thread start point W101 and the thread start end section Y. Also, effective thread start point X102 is a cross section which is formed by a bisector L102 which is formed in an acute angle ∠β of the thread end section Z which is formed by the thread end point W102, the center point C, and the end point 2102 and the thread end section Z.

A load test and a leak test are performed by using the above explained bottle can 102 and the cap 103. The experiment is performed for three variations for the bottle can members 102 and the caps 103 which have 38 mm size, 33 mm size, and 28 mm size of diameter D101 while varying the slant angle θ and the thread start point height h. For the experiment, the bottle can member 2 is used which has 0.24 to 0.4 mm thickness, an effective thread turn number 2.2 for an eight-pitch-per-inch which is disposed for the male thread section 5. A cap 103 is used which has a tension strength such as 180 to 230 N/mm$^2$.

In the load test, a force is applied gradually in an axial direction of the bottle can 102. If the bottle can 102 is folded by a force which is under 1600 N, it is evaluated as "unacceptable" (X). If the bottle can 102 is folded by a force which is over 1600 N, it is evaluated as "acceptable" (○). In the leak test, the weight of the capped bottle 101 is measured which is filled by 0.1 Mpa of inner pressure under an ordinary temperature condition such that the weight is measured under an ordinary temperature condition after maintaining the capped bottle 101 for an entire daytime under 37° C. condition. If the difference of the weight is under 0.2 mg, the capped bottle 101 is evaluated as "acceptable" (○). If the difference of the weight is over 0.2 mg, the capped bottle 101 is evaluated as "unacceptable" (X). The detail of the result of the experiment is shown in the above TABLE 1.

It is understood that, in the TABLE 1, if the thread start point height h becomes short; that is, if the slant angle θ becomes larger, there occurs a folding, and if the thread start point height h becomes long; that is, if the slant angle è becomes smaller, there occurs a leaking. By doing this, the range for the thread start point height h and the slant angle θ in which there do not occur a folding or a leaking is evaluated as ○, and the rest of them are evaluated as X. For ranges which is evaluated as ○ in the total evaluation are such that 3.6 mm≦h≦5.6 mm and 33.0°≦θ≦55.0° in a capped bottle can 1 which has 38 mm of an outer diameter D1 of the thread, 3.24 mm≦h≦4.74 mm and 32.5°≦θ≦54.6° in a capped bottle 1 which has 33 mm of an outer diameter D1 of the thread, and 3.4 mm≦h≦5.1 mm and 33.0°≦θ≦55.0° in a capped bottle can 1 which has 33 mm of an outer diameter D1 of the thread.

Also, the capped bottle can 1 of the present embodiment is formed so as to be in a range of the thread start point height h such as 3.24 h≦h≦5.6 mm; therefore, it is possible to obtain a desirable contact between the curl section 107 and the liner 112 under a predetermined inner pressure. That is, the interval between the female thread section 104 of the cap 103 and the ceiling plate 108 extends due to the inner pressure. Such an extension amount is determined by the thread start point height h; thus, it is possible to set the extension amount in which there is not a leaking by setting the thread start point height h within the above range. By doing this, it is possible to form the bottle can 102 which has a desirable sealing condition under a predetermined inner pressure condition. Also, it is possible to obtain a desirable contact condition by setting the thread start point height h in the above range in a case in which a knurl section 113 is formed between the female thread section 109 of the cap 103 and the ceiling surface section 108.

Also, the slant angle θ is formed so as to be in a range of 33°≦θ≦55°, thus, it is possible to a load resistance which can endure the force for compressing the cap 103 in a step for putting the cap 103. Also, the mouth section 104 is formed so as to have the effective thread turn number to be 2.0 to 2.5, thus, the cap 103 is not disposed to be shifted undesirably; therefore, it is possible to form the capped bottle can 102 to which the cap 103 is put reliably and restrict the increase in the torque for opening the cap.

Here, in the present embodiment, explanations are made by using the capped bottle can 201 which has three outer diameters D101 38 mm, 33 mm, and 28 mm for the thread. It is acceptable if the present invention is used for the capped bottle can 101 which has different outer diameter D101 for the thread.

Figure 12:
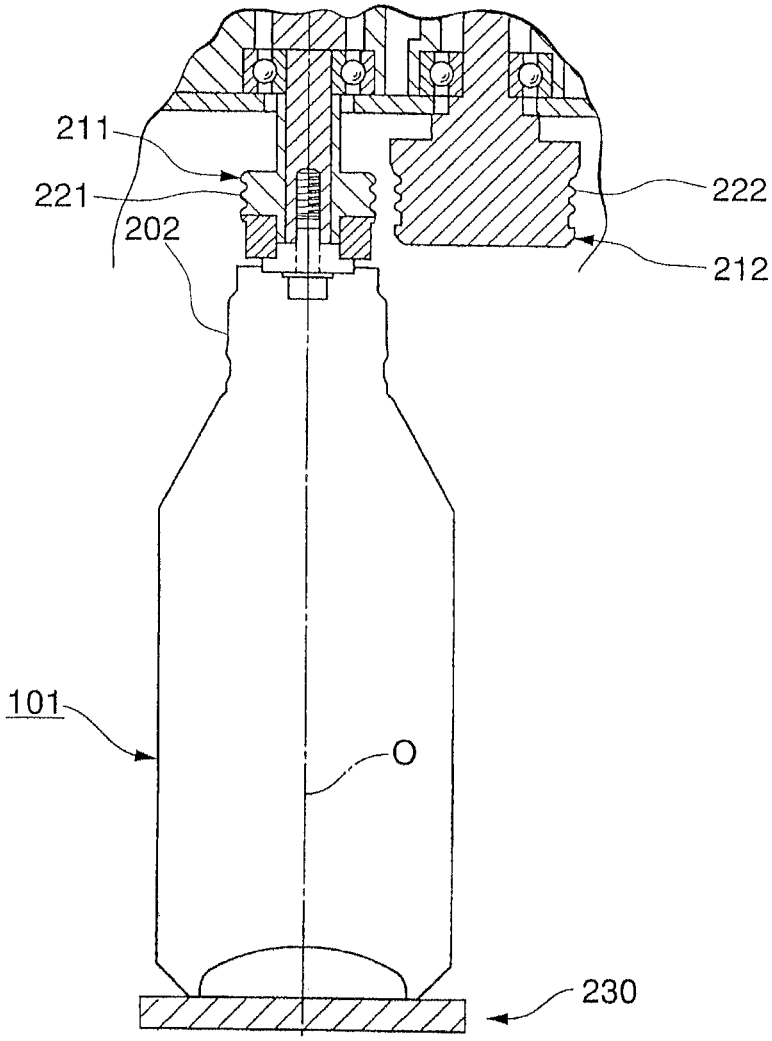
FIG. 12 is a view for explaining a thread forming device for performing the present invention.
Figure 13:
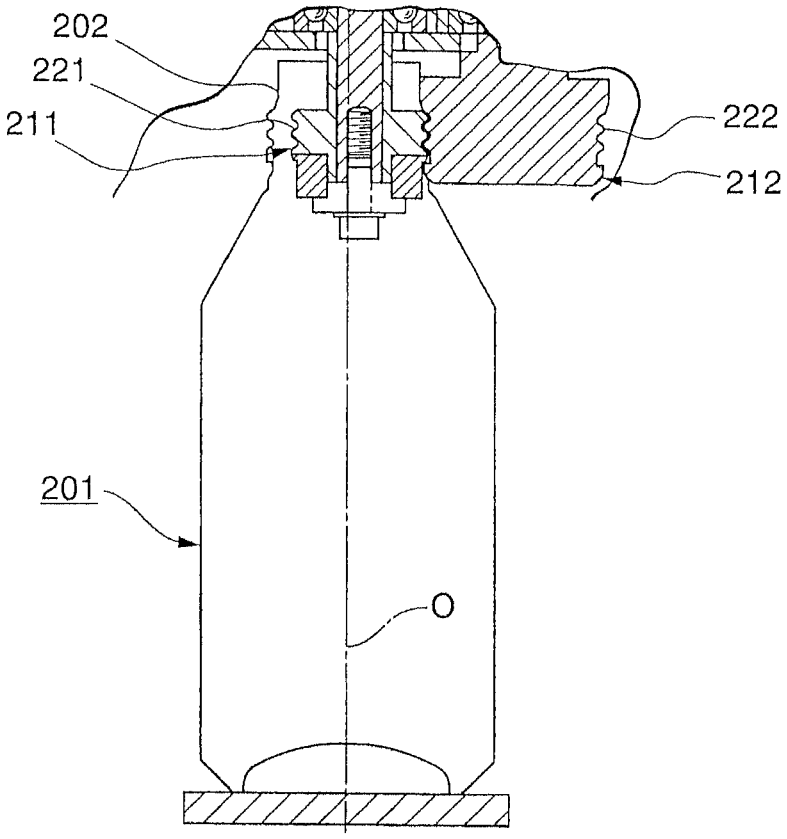
FIG. 13 is a view for showing a condition under which the thread section is formed in the mouth section of the bottle can member by the thread forming device.
Figure 14:
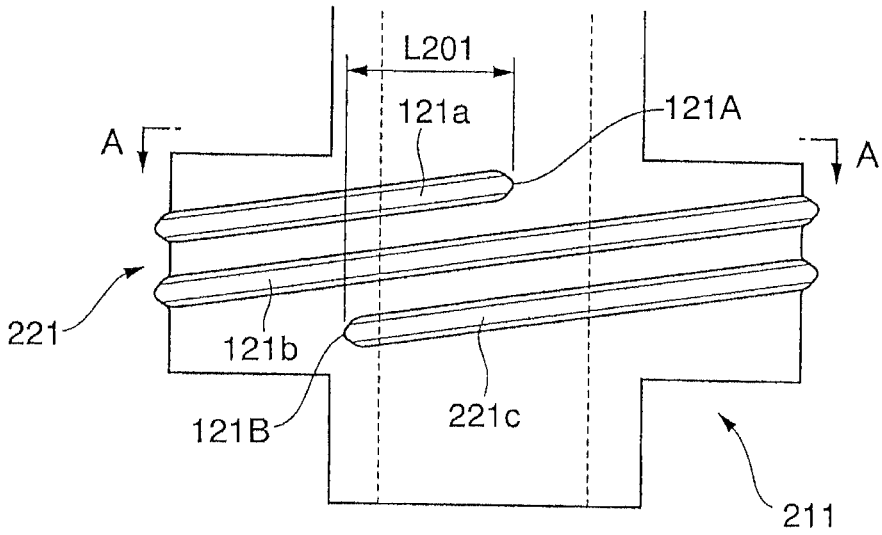
FIG. 14 is an external view for showing a core for the thread forming device.
Figure 15:
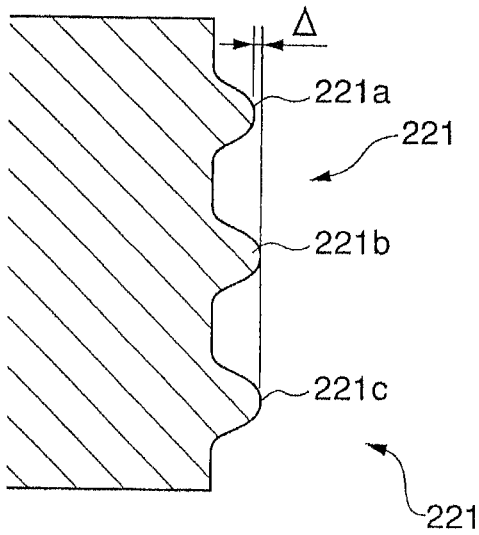
FIG. 15 is an enlarged view for a thread forming section in the core shown in FIG. 14.
Figure 16:
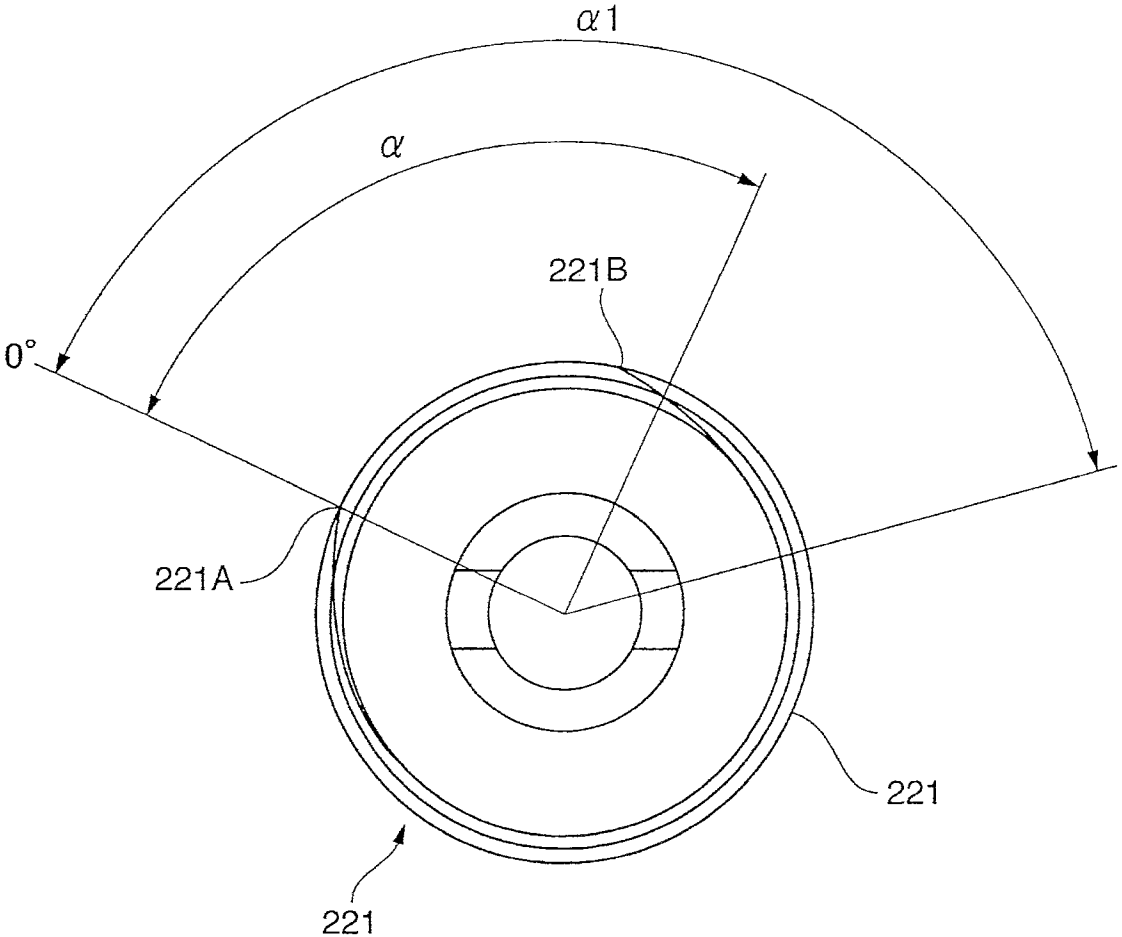
FIG. 16 is a corresponding view for showing an arrow A which is shown in FIG. 14.
Figure 17:
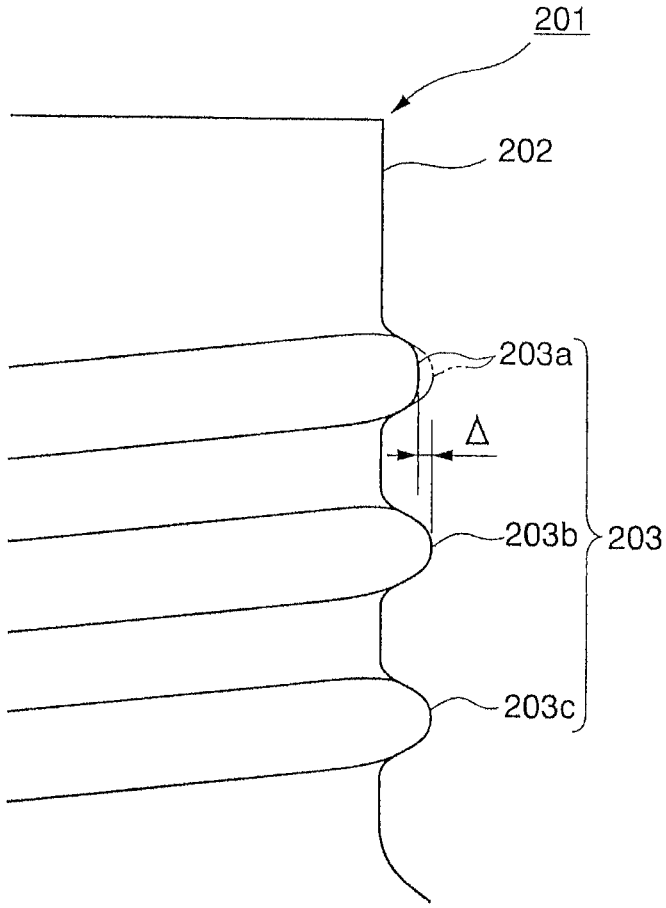
FIG. 17 is a view for showing a condition under which the thread section is formed in the mouth section of the bottle can member by the thread forming device.

Hereinafter, a third embodiments of the present invention are explained with reference to the drawings. FIGS. 12 to 17 are views for showing a method for forming a mouth section according to a third embodiment of the present invention. FIG. 12 is a view for explaining a thread forming device for performing a method for forming a mouth section. FIG. 13 is a view for explaining a condition for forming a thread section in the mouth section of the bottle can member by the thread forming device. FIG. 14 is an external view for showing a core of the thread forming device. FIG. 15 is an enlarged view for the thread forming section in the core which is shown in FIG. 14, FIG. 16 is a view which corresponds to an arrow A which is shown in FIG. 14. FIG. 17 is a view for showing a condition under which the thread section is formed in the mouth section of the bottle can member.

Figure 19A:
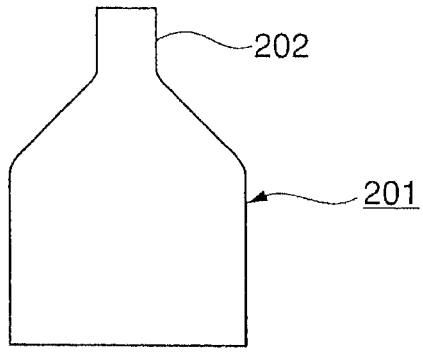
FIGS. 19A to 19C are views for showing conventional steps until forming a thread section on the bottle can member.
Figure 19B:
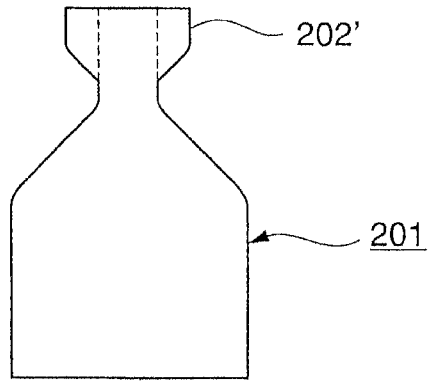
Figure 19C:
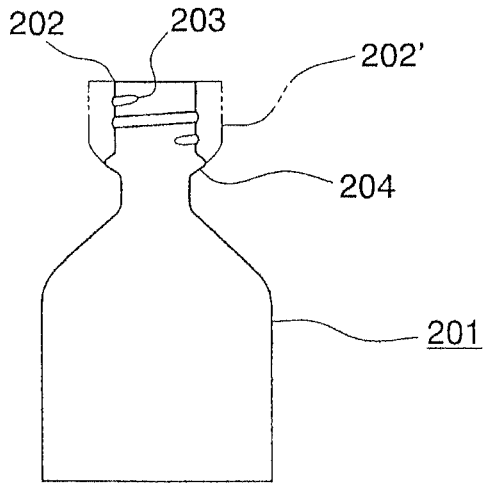
Figure 20:
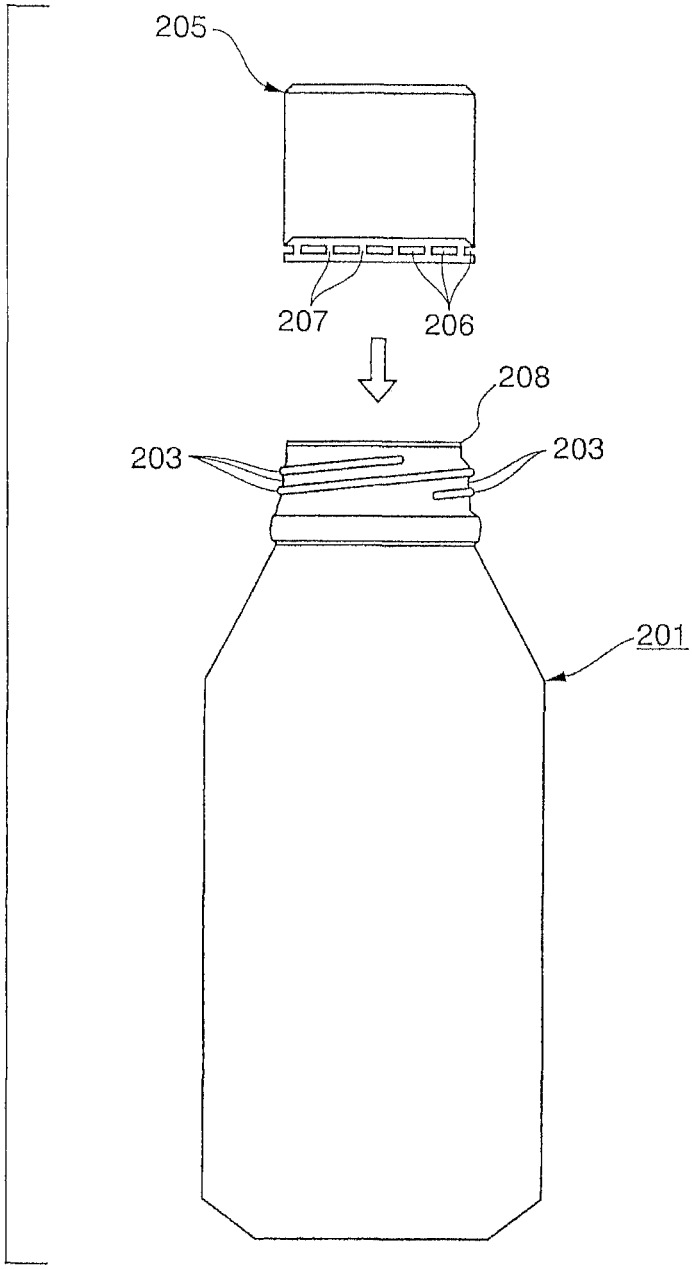
FIG. 20 is a view for explaining a cap which is put on the bottle can member which has a thread section.
Figure 21:
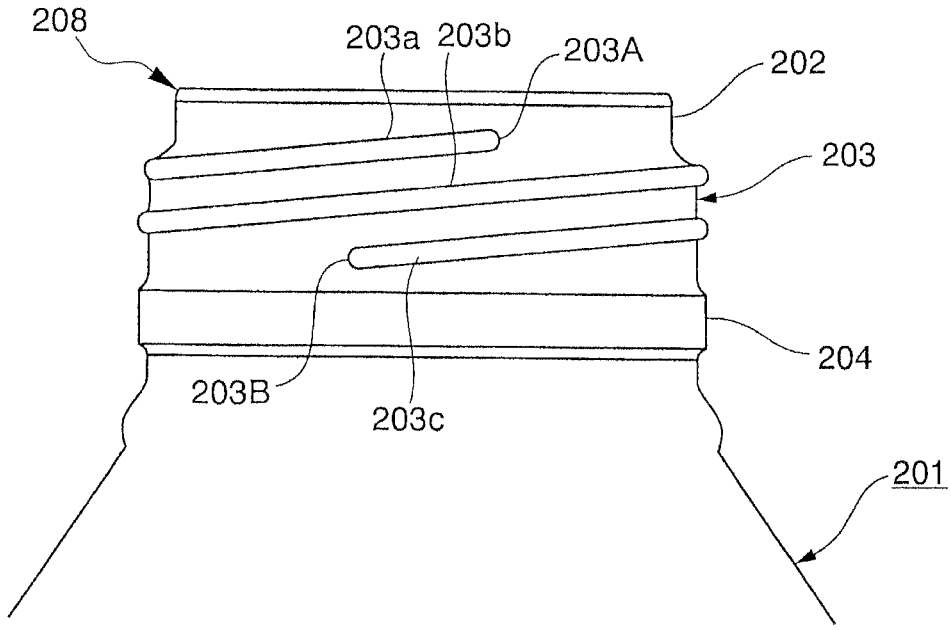
FIG. 21 is a view for explaining a conventional condition under condition that a thread section which has a thread turn number 2.2 on the mouth section of the bottle can member.
Figure 22:
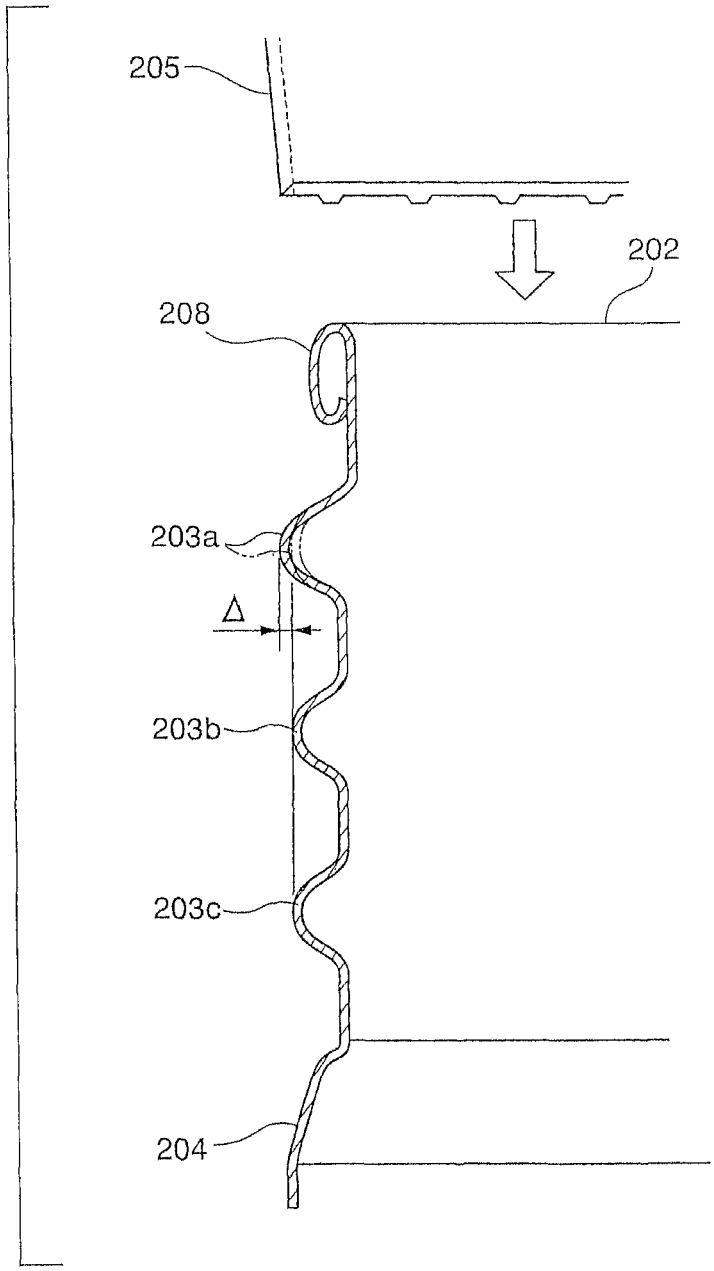
FIG. 22 is a view for explaining a problem which has occurred in the thread section of the bottle can.

Before explaining a method for forming a mouth section according to the present embodiment, the bottle can member 1 which is handled in a method for forming the mouth section serves for filling a content such as a carbonated beverage and a fruit beverage thereinside. The bottle can member 1 is formed so as to be in a bottomed cylindrical shape by a thin metal member which is made of an aluminum member or an aluminum alloy. After that, a mouth section 202 of which diameter is smaller than a diameter of a can body is formed in an aperture section of the bottle can member 201. After that, a thread section 203 is formed around a periphery of the mouth section 202 by a thread forming device 210 (See FIGS. 19A to 19C).

In the present invention, the effective thread turn number is 2.0 to 2.5 for the mouth section 202 of the bottle can member 201.

In addition, as a general structure, the thread forming device for performing a method for forming the mouth section is provided with a core 211 which contacts an inner periphery surface of the mouth section 202 of the bottle can 201, and an outer core 212 (outerside member) which contacts an outer periphery surface. The thread section 203 is formed around the mouth section 202 by rotating the core 211 and the outer core 212 around an axial center O of the bottle can member 201 while sandwiching the mouth section 202 by the core 211 and the outer core 212.

Thread forming sections 221, 222 which have concave and convex sections for forming a thread section 203 on its outer periphery surface are formed in a spiral manner and in a corresponding shape respectively as shown in FIGS. 12 and 13 in the core 211 and the outer core 212 so as to be rotated by a driving structure which is not shown in the drawings.

Although it is not described in the drawings, a work supporting section 230 has a chucking function so as to support a bottle can member 201 as a workpiece.

In the thread forming device 210, when the bottle can member 201 in which a bottom section is supported by a die ring 231 of the work supporting section 230 is positioned in a corresponding position as shown in FIG. 12, at first, a cylindrical surface which is not shown in the drawing is engaged to a can body section from a shoulder section of the bottle can member 201 by progressing the work supporting section 230. Furthermore, the core 211 moves to an inner periphery surface of the mouth section 202 of the bottle can member 201 so as to contact there, and the outer core 212 moves to an outer periphery surface of the mouth section 202 so as to contact there. By doing this, the core 211 and the outer core 212 sandwich the mouth section 212. Under the above condition, furthermore, the entire device 210 rotates around an axial center O. By doing this, the thread section 203 is formed in the mouth section 202.

In such a case, the thread turn number for the thread section 203 which is formed in the mouth section 202 of the bottle can member 201 is formed to be 2.2. In the thread section 203 which has 2.2 thread turn number as shown in FIG. 14, there is a thread area L which comprises a first thread 203*a*, a second thread 203*b*, and a third thread 203*c* on an outer periphery surface of the mouth section 202. Therefore, the thread forming section 221 which has a concave and convex section which is disposed on the core 211 is formed so as to correspond to the thread section 203 as shown in FIG. 14.

In the present embodiment, when the thread section 203 is formed so as to face an outer periphery of the mouth section 202, the first thread 203*a* is formed as shown in FIG. 17 so as to be lower than the second thread 203*b* and the third thread 203*c* by a slight difference such as a dimension Δ.

That is, as shown in FIG. 15, in the thread forming section 221 of the core 211, a height of the thread forming section 221*a* in a first stage is formed so as to be lower than the height of the thread forming section 221*b* in the second stage and the height of the thread forming section 221*c* in the third stage by a slight difference such as a dimension Δ. By doing this, when the thread section 203 is formed in the mouth section 202 of the bottle can member 201 by the core 211 and the outer core 212, as shown in a line in FIG. 17, the thread 203*a* in the first stage which is disposed near the thread start section 203A of the mouth section 202 is formed lower than the thread 203*b* in the second stage and the thread 203*c* in the third stage by a slight difference such as a dimension Δ in advance.

In such a case, a height such as 0.8 mm for the thread is set, the dimension Δ is lower than such a thread height by approximately 0.1 mm. Therefore, it is approximately 0.7 mm. However, it should be selected preferably from a stricter point of view.

Also, in the thread forming section 221 of the core 211, a range in which the thread forming section 221 in the first stage is lower than the thread 221*b* in the second stage and the third thread 221*c* in the third stage is indicated by an angle range α such as 90 degrees which includes the thread area L as shown in FIG. 16 in the present embodiment. In such a case, under condition that the thread start section 221A of the thread forming section 221*a* in the first stage is indicated by 0 (zero) degree, the angle range α is 90 degrees from 0 degree.

Here, in consideration of an area in which there is a possibility in that a thread turn number of the thread section 203 varies and the thread is crushed with regardless to the 90 degrees of the range, 360 degrees of the angle range is preferable. More preferably, the angle range 200 to 300 degrees (α1) is preferable.

Here, the thread start section 221A of the thread forming section 221 serves a section in which the thread section 203 which is formed in the mouth section 202 works as a screw effectively which corresponds to the thread start section 203A of the thread section 203. Therefore, the thread end section 221B and the thread end section 203B of the thread section 203 are formed correspondingly respectively.

Here, in FIGS. 1 to 6, the same reference numerals are add to the same sections as those in FIGS. 19A to 22.

This thread forming device 210 is formed in the above manner; therefore, an embodiment for a method of the present invention is explained next with reference to operations for the thread forming device 210.

First, in order to dispose a thread section 203 on the bottle can member 201, the bottle can member 201 in which a bottom section is supported at a work supporting section 230 which is formed by a die ring and a ring hollow flexible member which are not shown in the drawings is positioned in a corresponding position. A cylindrical surface which is not shown in the drawing is engaged to a shoulder section and a can body section of the bottle can member 201 by progressing the work supporting section 230. Furthermore, the core 211 moves to an inner periphery section of the mouth section 202 of the bottle can member so as to contact there. Simultaneously, the core 212 moves to an outer periphery section of the mouth section 202 so as to contact there. By doing this, the core 211 and the outer core 212 sandwich the mouth section 202. Furthermore, under such a condition, the entire device rotates around the axial center O. By doing this, a thread section 203 which is shown by a line in FIG. 17 is formed in the mouth section 202.

In such a case, the thread section 203 which has 2.2 thread turn number is formed along an outer periphery surface of the mouth section 202 by rotating the core 211 and the outer core 212, the height of the thread forming section 221*a* in the first stage of the core 211 is lower than the thread forming section 221*b* in the second stage and the thread forming section 221*c* in the third stage. Therefore, the thread 203*a* is lower than the height of the thread 203*b* in the second stage and the third thread 203*c* in the third stage respectively among the thread areas which are disposed in the mouth section 202.

After the thread section 203 is formed on an outer periphery of the mouth section 202 in such a manner, if a step for forming the cap is performed by a cap putting device which is not shown in the drawing in order to dispose a curl section 208 on a tip of the mouth section 202 which has the thread section 203, the cap putting device folds the tip of the mouth section 202 from thereoutside to thereinside so as to form the curl section 208 (FIGS. 20 and 22) while compressing the bottle can member 1 by the cap putting device. Therefore, the tip of the mouth section 202 receives a compressing force, and a thread 203*a* in the first stage in the mouth section 202 is crushed. By doing this, a diameter of the thread 203*a* in the first stage is enlarged in a manner which is shown in a dotted line shown in FIG. 17 instead of a line.

In such a case, as explained above, the thread 203*a* in the first stage in the mouth section 2 is formed lower than the thread 203*b* in the second stage and the thread 203*c* in the third stage by a dimension Δ in advance. Therefore, if a diameter is enlarged by a compressing force which is generated in a step for putting the cap, the height is approximately equal to the height of the thread 203*b* in the second stage and the height of the thread 203*c* in the third stage as a result.

Therefore, according to the present invention, if a compressing force is applied in a step for putting the cap on a tip of the mouth section 202 after the thread 203*a* in the first stage in the thread section 203 of the thread section 202 is formed lower in advance, it is possible to form the height of the thread 203*a* in the first stage, the height of the thread 203*b* in the second stage, and the height of the thread 203*c* in the third stage approximately equally by such a compressing force; therefore, it is possible to equalize the height of the threads approximately.

Therefore, if the cap 205 is put on such a bottle can member 201, the cap 205 is formed in a bottomed cylindrical shape in which a diameter of the ceiling plate and a diameter of an aperture end are approximately the same. Therefore, the user can close the cap smoothly after opening the bottle can member 201; thus, the user may not feel any uncomfortness. Therefore, it is possible to solve a conventional problem in that the cap may be deformed in an undesirable conical shape. Thus, it is possible to enhance the reliability.

In addition, according to the thread forming device 210, it is possible to form the thread 203*a* in the first stage in the thread section 203 of the mouth section 202 in advance by forming only the height of the thread forming section 221*a* in the first stage in the core 211 so as to be lower than other thread forming sections 221*b* and 221*c*. Thus, it is possible to form the thread section 203 reliably in which it is possible to close the cap desirably.

Figure 18:
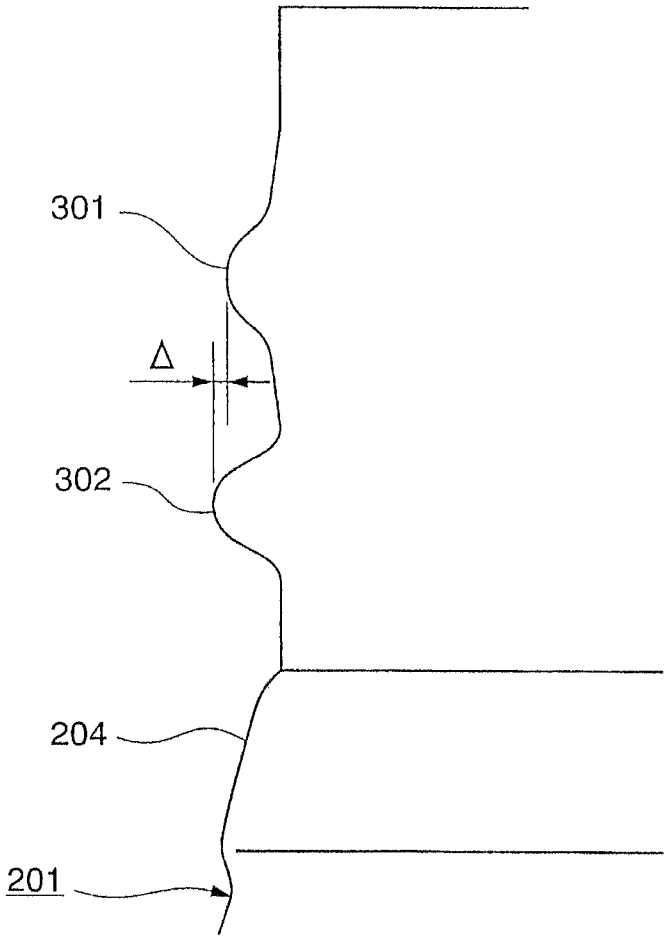
FIG. 18 is an enlarged view for explaining an important part which shows a thread section which is disposed in the mouth section of the bottle can member.

FIG. 18 is an enlarged view for explaining an important part which shows a thread section which is disposed in the mouth section of the bottle can member according to a second embodiment of the present invention.

If the thread section 203 which has a thread turn number 2.2 is formed on the mouth section 202 of the bottle 201, there are two stages of thread except the thread area in which there are three stages of thread.

The present embodiment takes the thread section 203 in which there are two stages of thread into consideration. Here, the height of the thread 301 in the first stage is formed so as to be lower than the height of the thread 302 in the second stage.

That is, the thread 301 in the first stage is formed so as to be in an area except an area (L) in which there are three stages and an incomplete thread section of the thread end section such that the height of the thread 301 in the first stage should be lower than the thread 302 in the second stage only by a dimension Δ. Therefore, the thread forming section 221 of the core 211 in the thread forming device 210 is formed according to such a height and the height of the threads 301, 302.

According to the present embodiment, the height of the thread 301 in the first stage is formed so as to be lower than the height of the thread 302 in the second stage. Therefore, it is possible to form the thread 301 in the first stage and the thread 302 in the second stage so as to be in an equal height approximately.

Also, in the embodiment which is shown in the drawing, an example is shown in which the thread section 203 is formed which has a thread turn number 2.2 in the mouth section 202 of the bottle can member 1 by the thread forming device 210. Such a structure can be used for various cases in which the thread turn number is increased more than 2.2 such as the thread turn number 2.5. Thus, the present invention is not limited to the embodiments which are described here.

Here, in the embodiments which are shown in the drawings, an example is shown in which the thread forming device 210 uses the outer core 212 which rotates around the axial center O together with the core 211 while contacting the outer periphery of the mouth section 202. It is acceptable if other outer member which can form the core 211 and the thread section 203 instead of the outer core 212. Thus, the present invention is not limited to the embodiments which are described here.

INDUSTRIAL APPLICABILITY

As explained above, according to the present invention, the effective thread turn number for the thread section of the mouth section is formed to be 2.0 to 2.5; therefore, the bridge is not broken if the cap is put on the bottle can member. Thus, the cap is put desirably. Also, the effective thread turn number is 2.0 to 2.5; therefore, a compression amount of the mouth section in an axial line direction is approximately equal over a circumference direction when the cap is put; thus, it is possible to enhance the sealing condition.

The invention claimed is:

1. A method for manufacturing a DI can member using a bottle can member produced by drawing and ironing a metal plate, comprising the steps of:

forming a mouth section by processing an aperture section of the bottle can member so as to reduce a diameter of the aperture section;

forming an enlarged-diameter section by processing the aperture section so as to enlarge the diameter of the aperture section by a predetermined distance from an upper end of the mouth section;

decreasing a diameter of a portion of the enlarged-diameter section to provide a thread section and to form an expanding section remote from the thread section where the diameter of the enlarged-diameter section is not decreased;

forming a thread on the thread section after forming the expanding section; and forming a curl section on the upper end of the mouth section after the thread is formed.

2. The method for manufacturing a DI can member according to claim 1, wherein in the step of forming the thread, a plurality of stages of the thread are formed around an outer periphery of the mouth section of the bottle can member, and a height of a first stage of the thread which is disposed near the upper end of the mouth section of the bottle can member is set to be lower than a height of other stages of the thread in a predetermined angle range.

3. The method for manufacturing a DI can member according to claim 2, wherein the predetermined angle range is a range within 90 degrees from a thread start point of the thread section.

* * * * *